US009551198B2

(12) United States Patent
Porter et al.

(10) Patent No.: US 9,551,198 B2
(45) Date of Patent: Jan. 24, 2017

(54) RAM DEVICE OPERABLE WITH WELLBORE TUBULARS

(71) Applicant: Bastion Technologies, Inc., Houston, TX (US)

(72) Inventors: Charles C. Porter, Houston, TX (US); Dana Karl Kelley, Friendswood, TX (US); Charles Don Coppedge, Houston, TX (US); Hildebrand Argie Rumann, League City, TX (US)

(73) Assignee: Bastion Technologies, Inc., Houston, TX (US)

( * ) Notice: Subject to any disclaimer, the term of this patent is extended or adjusted under 35 U.S.C. 154(b) by 0 days.

(21) Appl. No.: 14/336,761

(22) Filed: Jul. 21, 2014

(65) Prior Publication Data

US 2014/0326462 A1 Nov. 6, 2014

Related U.S. Application Data

(63) Continuation of application No. 13/220,593, filed on Aug. 29, 2011, now Pat. No. 8,783,357.

(60) Provisional application No. 61/377,851, filed on Aug. 27, 2010.

(51) Int. Cl.

| | |
|---|---|
| ***E21B 29/12*** | (2006.01) |
| ***E21B 17/10*** | (2006.01) |
| ***E21B 41/04*** | (2006.01) |
| ***E21B 33/038*** | (2006.01) |
| ***E21B 33/00*** | (2006.01) |

(52) U.S. Cl.

CPC ..... *E21B 29/12* (2013.01); *E21B 33/00* (2013.01); *E21B 33/038* (2013.01); *E21B 2033/005* (2013.01)

(58) Field of Classification Search

CPC ..... E21B 33/038; E21B 29/12

USPC ..... 166/338, 340, 352, 359, 361, 363, 364,166/365, 297, 298, 377, 55, 85.1

See application file for complete search history.

(56) References Cited

U.S. PATENT DOCUMENTS

| | | | | |
|---|---|---|---|---|
| 3,884,298 | A * | 5/1975 | Watkins | 166/351 |
| 3,955,622 | A * | 5/1976 | Jones | E21B 17/1007 166/352 |
| 4,376,467 | A | 3/1983 | Allen | |
| 4,478,287 | A * | 10/1984 | Hynes | E21B 7/128 166/341 |
| 6,269,883 | B1 | 8/2001 | Gissler et al. | |
| 2004/0003926 | A1 | 1/2004 | Nivens et al. | |
| 2004/0124380 | A1* | 7/2004 | Van Winkle | 251/1.3 |
| 2005/0061499 | A1 | 3/2005 | Hopper | |
| 2006/0151175 | A1 | 7/2006 | Sundararajan et al. | |
| 2007/0137866 | A1* | 6/2007 | Ravensbergen | E21B 19/22 166/384 |
| 2008/0105435 | A1 | 5/2008 | Inderberg | |

(Continued)

*Primary Examiner* — Matthew R Buck
*Assistant Examiner* — Stacy Warren
(74) *Attorney, Agent, or Firm* — Winstead PC

(57) ABSTRACT

A ram or shutter device includes rams operable between an open position withdrawn from a bore to a closed position to contact a tubular disposed in the bore, the rams may not seal the bore. A well system in accordance to an aspect of the disclosure includes an assembly providing a bore in communication with a wellbore, a device operable to shear a tubular disposed in the bore, and a shutter device having rams operable between an open position withdrawn from the bore to a closed position contacting the tubular in the bore.

26 Claims, 20 Drawing Sheets

(56) References Cited

U.S. PATENT DOCUMENTS

| | | | | |
|---|---|---|---|---|
| 2010/0025044 | A1* | 2/2010 | McKay | E21B 33/076 166/359 |
| 2011/0284237 | A1* | 11/2011 | Baugh | 166/365 |

* cited by examiner

RAM DEVICE OPERABLE WITH WELLBORE TUBULARS

BACKGROUND

This section provides background information to facilitate a better understanding of the various aspects of the disclosure. It should be understood that the statements in this section of this document are to be read in this light, and not as admissions of prior art.

A blowout preventer is a large, specialized valve used to seal, control and monitor oil and gas wells. Blowout preventers are designed to cope with extreme erratic pressures and uncontrolled flow emanating from a well during drilling. Pressure kicks can lead to the uncontrolled release of oil and/or gas from a well resulting in a potentially subsea well event known as a blowout. Blowout preventers are critical to the safety of crew, equipment and environment, and to the monitoring and maintenance of well integrity. While blowout preventers are intended to be fail-safe devices, accidents may still occur if the blowout preventer fails to properly operate. For example, during the Apr. 20, 2010, Deepwater Horizon drilling rig explosion, it is believed that the blowout preventers may not have properly operated and/or were not activated in a timely fashion. In addition to loss of well control the wellhead equipment was damaged creating obstacles to recovering control of the well.

SUMMARY

A device includes rams operable between an open position withdrawn from a bore to a closed position to contact a tubular disposed in the bore. In accordance to an aspect of some embodiments, the rams do not seal the bore. A well system in accordance to an aspect of the disclosure includes an assembly providing a bore in communication with a wellbore, a device operable to shear a tubular disposed in the bore, and a shutter device comprising rams operable between an open position withdrawn from the bore to a closed position contacting the tubular in the bore, wherein the rams do not seal against the tubular. A method in accordance to an aspect of the disclosure includes actuating rams of a shutter device to a closed position to contact a tubular disposed through an axial bore, the rams may not seal the bore. After actuating the shutter device to the closed position the tubular may be sheared in the bore, for example using a tubular shear. After actuating the shutter device to the closed position the tubular device may be engaged in the bore, for example one or more slips may be actuated to engage the tubular.

The foregoing has outlined some of the features and technical advantages in order that the detailed description that follows may be better understood. Additional features and advantages will be described hereinafter which form the subject of the claims of the invention. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
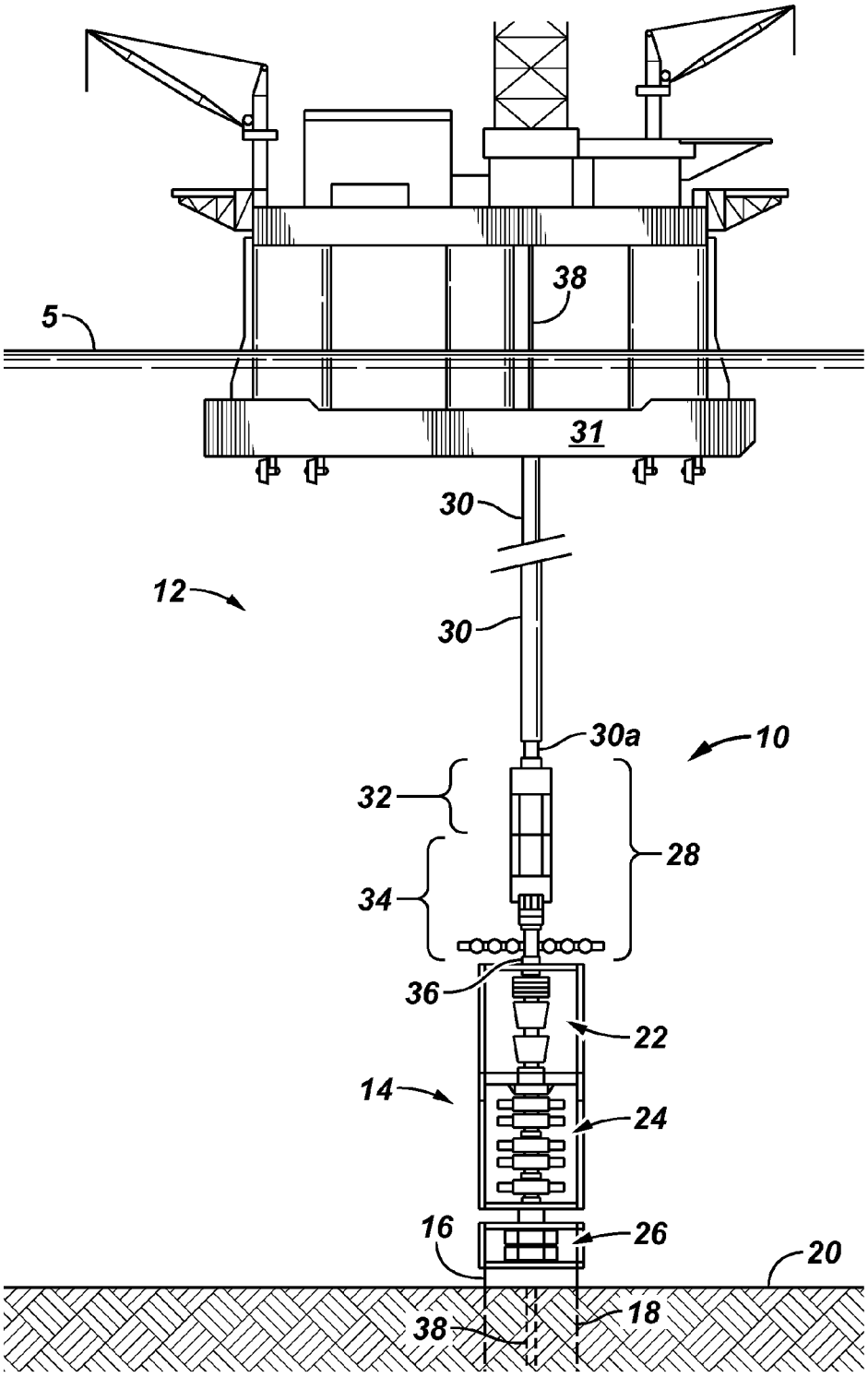
FIG. 1 a schematic illustration of a subsea safing system according to one or more aspects of the disclosure utilized in a subsea well drilling system.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as the top point and the total depth of the well as the lowest point, wherein the well (e.g., wellbore, borehole) is vertical, horizontal or slanted relative to the surface.

In this disclosure, "hydraulically coupled" or "hydraulically connected" and similar terms, may be used to describe bodies that are connected in such a way that fluid pressure may be transmitted between and among the connected items. The term "in fluid communication" is used to describe bodies that are connected in such a way that fluid can flow between and among the connected items. It is noted that hydraulically coupled may include certain arrangements where fluid may not flow between the items, but the fluid pressure may nonetheless be transmitted. Thus, fluid communication is a subset of hydraulically coupled.

A subsea well safing system is disclosed to provide a means for mitigating the environmental and economic damage that can result from the loss of control of a well, such as occurred in the Macondo well being drilled from the Deepwater Horizon on 20 Apr. 2010. According to one or more aspects, the subsea well safing system provides a mechanism to separate the marine riser from the blowout preventer stack and the well in a manner intended to mitigate the physical damage to the well drilling system and to enhance the potential for successfully reconnecting to the well, for example via the BOP stack, to regain control of the well.

FIG. 1 is a schematic illustration of a subsea well safing system, generally denoted by the numeral 10, being utilized in a subsea well drilling system 12. In the depicted embodiment drilling system 12 includes a BOP stack 14 which is landed on a subsea wellhead 16 of a well 18 (i.e., wellbore) penetrating seafloor 20. BOP stack 14 conventionally includes a lower marine riser package ("LMRP") 22 and blowout preventers ("BOP") 24. The depicted BOP stack 14 includes subsea test valves ("SSTV") 26. As will be understood by those skilled in the art with benefit of this disclosure, BOP stack 14 is not limited to the devices depicted.

Figure 2:
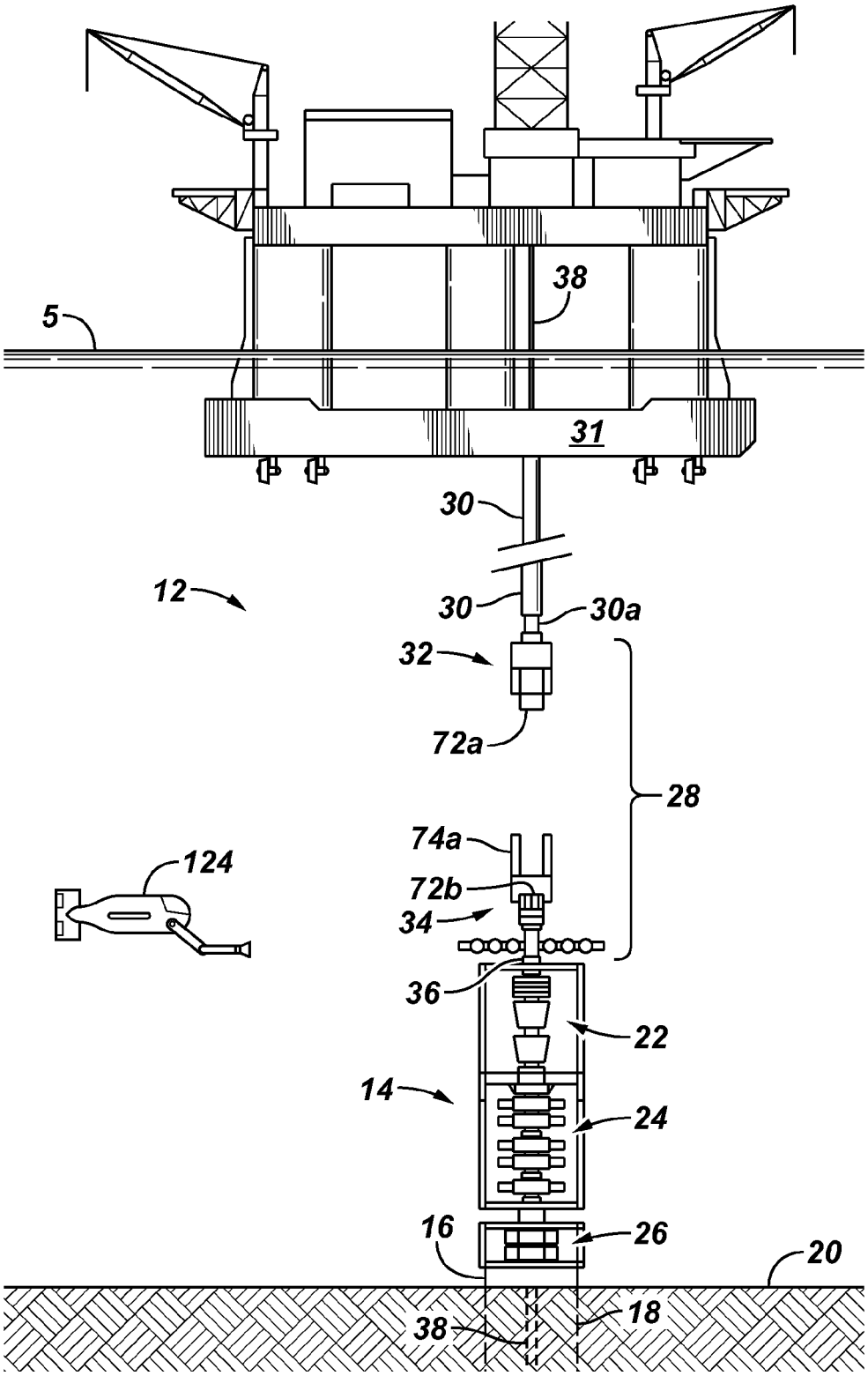
FIG. 2 depicts a subsea safing system according to one or more aspects, wherein the safing sequence has been initiated and the marine riser and upper safing package are physically and hydraulically disconnected from the lower safing package, the BOP stack, and the well.
Figure 7:
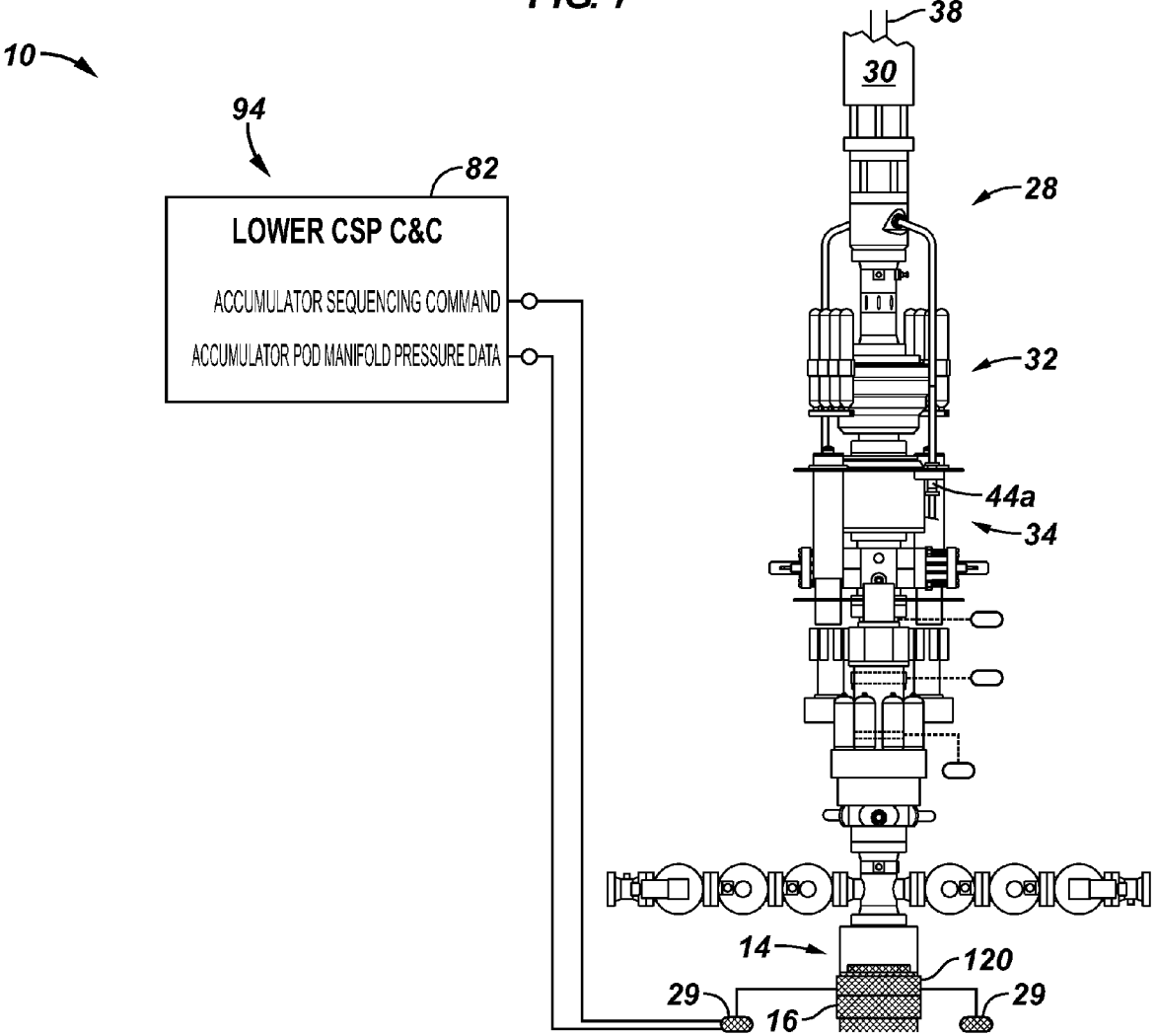

Subsea well safing system 10 includes a safing package, or assembly, generally referred to herein as a catastrophic safing package ("CSP") 28 that is landed on BOP system 14 and operationally connects a marine riser 30 extending from platform 31 (e.g., vessel, rig, ship, etc.) to BOP stack 14 and thus well 18. CSP 28 includes an upper CSP 32 and a lower CSP 34 that are configured to separate from one another in response to initiation and implementation of a safing sequence thereby disconnecting marine riser 30 from the BOP stack 14 and well 18, for example as illustrated in FIG. 2. The safing sequence is initiated in response to parameters indicating the occurrence of a failure in well 18 with the potential of leading to a blowout of the well. Subsea well safing system 10 may automatically initiate the safing sequence in response to the correspondence of monitored parameters to selected safing triggers. CSP 28 may include an accumulator 29, see e.g. FIGS. 3 and 7, hydraulically connected to wellhead 16 to operate the wellhead connector lock as further described below. In FIG. 7, wellhead accumulator 29 is depicted as a standalone, accumulator located proximate to seafloor 20 and wellhead 16.

Wellhead 16 is a termination of the wellbore at the seafloor and generally has the necessary components (e.g., connectors, locks, etc.) to connect components such as BOPs 24, valves (e.g., test valves, production trees, etc.) to the wellbore. The wellhead also incorporates the necessary components for hanging casing, production tubing, and subsurface flow-control and production devices in the wellbore.

BOP stack 14 commonly includes a set of two or more BOPs 24 utilized to ensure pressure control of well 18. A typical stack might have one to six ram-type preventers and, optionally, one or two annular-type preventers. A typical stack configuration has the ram preventers on the bottom and the annular preventers at the top. The configuration of the stack preventers is optimized to provide maximum pressure integrity, safety and flexibility in the event of a well control incident. For example, one set of rams may be fitted to close on the drillpipe, blind rams to close on the open hole, and another set of shear rams to cut and hang-off the drillpipe. It is also common to have an annular preventer at the top of the stack to close over a wide range of tubular (e.g., drillpipe) sizes and the open hole. BOP stack 14 also includes various spools, adapters, and piping ports to permit circulation of wellbore fluids under pressure in the event of a well control incident.

LMRP 22 and BOP stack 14 are coupled together by a wellbore connector that is engaged with a corresponding mandrel on the upper end of BOP stack 14. LMRP 22 typically provides the interface (i.e., connection) of the BOPs 24 and the bottom end 30*a* of marine riser 30 via a riser connector 36 (i.e., riser adapter). Riser connector 36 may include a flex joint that provides for a range of angular movement of riser 30 (e.g., 10 degrees) relative to BOP stack 14, for example to compensate for vessel 31 offset and current effects along the length of marine riser 30. Riser connector 36 may include one or more ports for connecting fluid (i.e., hydraulic) and electrical conductors, i.e., communication umbilical, which may extend along (exterior or interior) marine riser 30 from the drilling platform located at surface 5 to subsea drilling system 12. For example, it is common for a hydraulic choke line 44 and a hydraulic kill line 46 to extend from the surface for connection to BOP stack 14.

Marine riser 30 is a tubular string that extends from the drilling platform 31 down to well 18. The marine riser is in effect an extension of the wellbore extending through the water column to drilling vessel 31. The marine riser diameter is large enough to allow for drillpipe, casing strings, logging tools and the like to pass through. For example, in FIGS. 1 and 2, a tubular 38 (e.g., drillpipe) is illustrated deployed from drilling platform 31 into marine riser 30. Drilling mud and drill cuttings can be returned to surface 5 through marine riser 30, for example through the annulus between drillpipe and the riser. Communication umbilicals (e.g., hydraulic, electric, optic, etc.) can be deployed exterior to or through marine riser 30 to CSP 28 and BOP stack 14. A remote operated vehicle ("ROV") 124 is depicted in FIG. 2 and may be utilized for various tasks.

Figure 3:
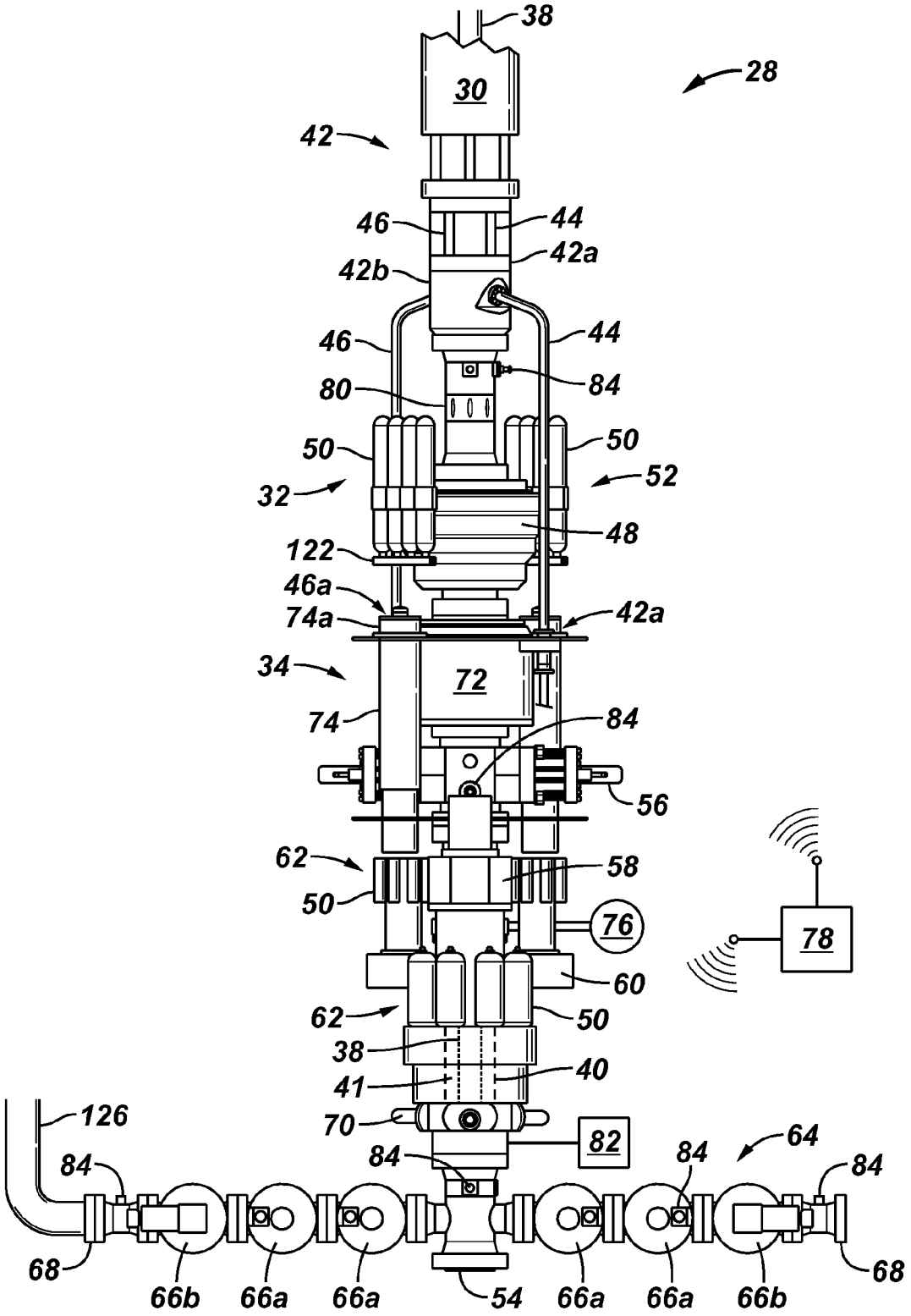
FIG. 3 illustrates a subsea well safing assembly according to one or more aspects of the disclosure.

Refer now to FIG. 3 which illustrates a subsea well safing package 28 in accordance to an aspect of one or more embodiments. CSP 28 depicted in FIG. 3 is further described with reference to FIGS. 1 and 2. The illustrated CSP 28 has an upper CSP 32 and a lower CSP 34. Upper CSP 32 includes a riser connector 42 which may include a riser flange connection 42*a*, and a riser adapter 42*b* which may provide for connection of communication umbilicals and extension of the communication umbilicals to various CSP 28 devices and/or BOP stack 14 devices. For example, a choke line 44 and a kill line 46 are depicted extending from the surface with riser 30 and extending through riser adapter 42*b* for connection to the choke and kill lines of BOP stack 14. The illustrated CSP 28 includes a choke stab 44*a* and a kill line stab 46*a* for interconnecting the upper portion of choke line 44 and kill line 46 with the lower portion of choke line 44 and kill line 46. As will be further described below with reference to safing sequence 86, stabs 44*a*, 46*a* also provide for disconnecting from the stab and kill lines during a safing operations and during subsequent recovery and reentry operations reconnecting to the choke and kill lines via stabs. The riser connector 42 may include a flex joint.

CSP 28 has an internal longitudinal extending bore 40, depicted in FIG. 3 by the dashed line through lower CSP 34, for passing tubular 38. Annulus 41 is formed between the outside diameter of tubular 38 and the inside diameter of bore 40.

Upper CSP 32 includes slips 48 (i.e., safety slips) to close on tubular 38 and secure tubular 38 in the upper assembly. Slips 48 are actuated in the illustrated system by hydraulic pressure from an accumulator 50. Depicted CSP 28 includes a plurality of hydraulic accumulators 50 which may be interconnected in pods, such as upper accumulator pod 52. As will be understood by those skilled in the art with benefit of the present disclosure, accumulators 50 may be provided in various configurations. The depicted accumulators 50 are hydraulically charged and do not require connection to a hydraulic source at the surface. It will also be recognized by those skilled in the art that hydraulic pressure may be provided from the surface. In this embodiment, accumulators 50 located in the upper accumulator pod 52 are at least hydraulic connected to slips 48. The pressure in accumulators 50 can be monitored and accumulators 50 may be actuated in sequence as needed to ensure that adequate hydraulic pressure is available to actuate CSP devices such as slips 48.

Lower CSP 34 includes a connector 54 to connect to the subsea well, rams 56 (e.g., blind rams), high energy shears 58, lower slips 60 (e.g., bi-directional slips), and a vent system 64 (e.g., valve manifold). In FIGS. 1 and 2 CSP 28 is illustrated connected to the subsea well and wellhead through BOP stack 14, for example, via riser connector 36 of the LMRP 22. Vent system 64 may include one or more valves 66. Vent system 64 is depicted with vent valves (e.g., ball valves) 66*a*, choke valves 66*b*, and one or more connection mandrels 68. Valves 66*b* can be utilized to control fluid flow through connection mandrels 68. For example, a recovery riser 126 is depicted connected to one of mandrels 68 for flowing effluent from the well and/or circulating a kill fluid (e.g., drilling mud) into the well as further described below. Vent system 64 is further described below with reference to FIGS. 5 and 5A.

Lower CSP 34 is depicted in FIG. 3 with a deflector or shutter device 70 (e.g., impingement device) disposed above vent system 64 and below lower slips 60, shears 58 and blind rams 56. Lower CSP 34 includes a plurality of hydraulic accumulators 50 that are arranged and connected in one or more lower hydraulic pods 62 for operations of various devices of CSP 28. As will be further described below, CSP 28 may be operationally connected to a chemical source 76, e.g. methanol, to mitigate hydrate formation. For example, a chemical such as methanol may be injected in lower CSP 34 to prevent hydrate formation for example when vents 66 are opened.

Upper CSP 32 and lower CSP 34 are detachably connected to one another by a connector 72. CSP connector 72 includes a first connector portion 72*a* and a second mandrel connector portion 72*b* which are illustrated for example in FIG. 13A, for example a collet connector. An ejector device 74 (e.g., ejector bollards) is operationally connected between upper CSP 32 and lower CSP 34 to separate upper CSP 32 and marine riser 30 from lower CSP 34 and BOP stack 14 after connector 72 has been actuated to the unlocked position. The depicted CSP 28 also includes a plurality of sensors 84 which can sense various parameters, such as and without limitation, temperature, pressure, strain (tensile, compression, torque), vibration, and fluid flow rate. Sensors 84 further includes, without limitation, erosion sensors, position sensors, and accelerometers and the like. Sensors 84 can be in communication with one or more control and monitoring systems, for example as further described below, forming a limit state sensor package.

CSP 28 includes a control system 78, which may be located subsea for example at CSP 28, or at a remote location such as at the surface. Control system 78 may include one or more controllers that may be located at different locations. For example, a depicted control system 78 includes an upper controller 80 (e.g., upper command and control data bus) and a lower controller 82 (e.g., lower command and controller bus). Control system 78 may be connected via conductors (e.g., wire, cable, optic fibers, hydraulic lines) and/or wirelessly (e.g., acoustic transmission) to various subsea devices and to surface (i.e., drilling platform 31) control systems.

With reference to FIGS. 3 to 17, depicted control system 78 includes upper controller 80 and lower controller 82. Each of upper and lower controllers 80, 82 may have a collection of real-time computer circuitry, field programmable gate arrays (FPGA), I/O modules, power circuitry, power storage circuitry, software, and communications circuitry. One or both of upper and lower controller 80, 82 may include control valves.

One of the controllers, for example lower controller 82, may serve as the primary controller and provide command and control sequencing to various subsystems of safing package 28 and/or communicate commands from a regulatory authority for example located at the surface. The primary controller, e.g., lower controller 82, contains communications functions, and health and status parameters (e.g., riser strain, riser pressure, riser temperature, wellhead pressure, wellhead temperature, etc.). One or more of the controllers may have black-box capability (e.g., a continuous-write storage device that does not require power for data recovery).

Upper controller 80 is described herein as operationally connected with a plurality of sensors 84 positioned throughout CSP 28 and may include sensors connected to other portions of the drilling system, including along riser 30, at wellhead 16, and in well 18. Upper controller 80, using data communicated from sensors 84, continuously monitors limit state conditions of drilling system 12. According to one or more embodiments, upper controller 80, may be programmed and reprogrammed to adapt to the personality of the well system based on data sensed during operations. If a defined limit state is exceeded an activation signal (e.g., alarm) can be transmitted to the surface and/or lower controller 82. A safing sequence may be initiated automatically by control system 78 and/or manually in response to the activation signal.

Figure 4A:
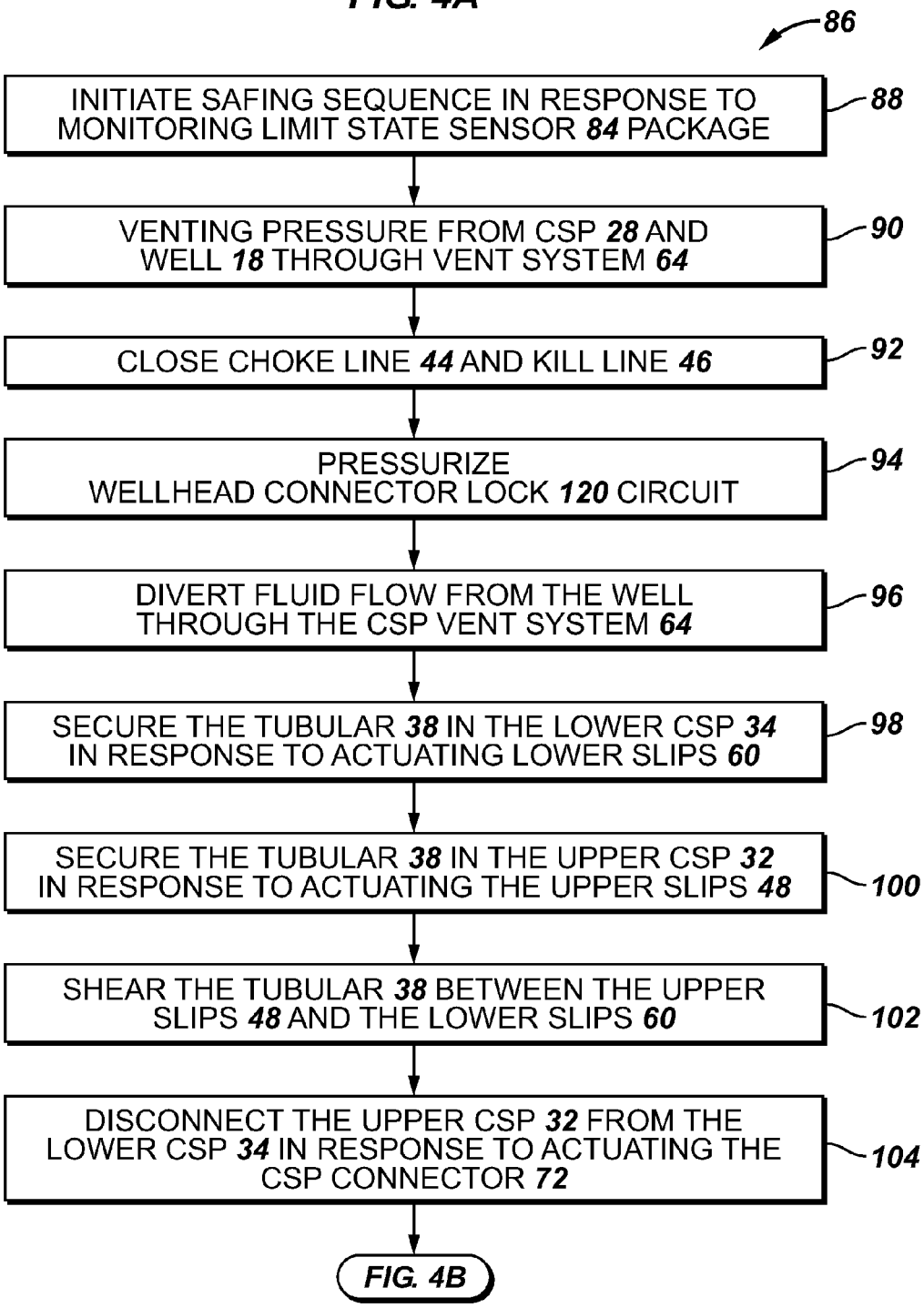
FIG. 4A-4B is a flow chart of a subsea well safing sequence according to one or more aspects of a subsea well safing system.
Figure 4B:
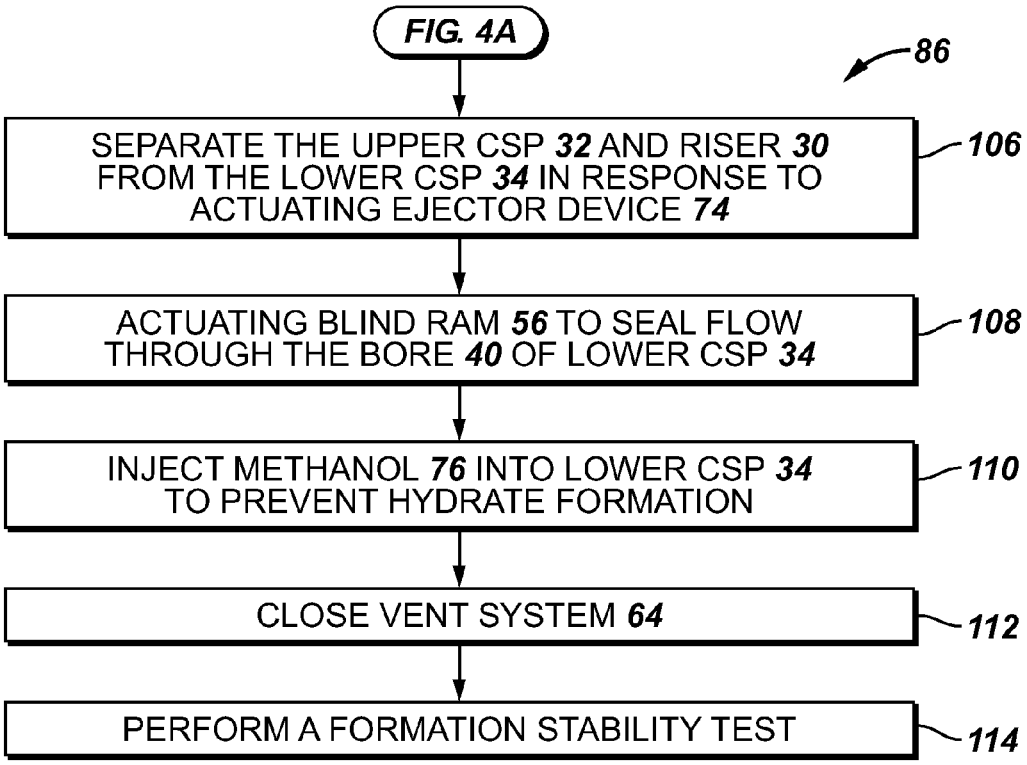

With reference to FIGS. 4A and 4B, a safing sequence 86 according to one or more aspects of subsea well safing system 10 is illustrated. In sequence block 88, the safing sequence is initiated in response to monitoring the limit state sensor 84 package for example by upper controller 80. In sequence block 90, pressure is vented from CSP 28 by opening a valve 66*a* in vent system 64, see, e.g., FIGS. 1, 3, 5 and 5A. In sequence block 92, the choke and kill lines are closed to prevent combustibles from flowing up from the well and to the surface through the kill and choke lines, see, e.g., FIGS. 1, 3 and 6. In sequence block 94, the wellhead 16 connector lock is pressurized to prevent accidental ejection of BOP stack 14 from wellhead 16, see, e.g., FIGS. 3 and 7. In sequence block 96, fluid flowing up from the well is diverted, e.g., partially diverted, to the open vents to prevent erosion of CSP elements such as the slips 48, 60, see, e.g., FIGS. 1, 3, 8, 8A and 8B. For example, fluid flow may be diverted by operating a deflector or shutter device 70 to a closed position. The rams of device 70 may act to center the tubular in the bore of the safing assembly prior to securing the tubular with the slips and/or prior to shearing the tubular. In sequence block 98, tubular 38 is secured in lower CSP 34 by closing lower slips 60 (e.g., bi-directional slips), see, e.g., FIGS. 1, 3 and 9. In sequence block 100, tubular 38 is secured in upper CSP 32 by closing upper slips 48 (e.g., safety slips), see, e.g., FIGS. 1, 3 and 10. In sequence block 102, tubular 38 is sheared in lower CSP 34 by activating shears 58, see, e.g., FIGS. 1, 3 and 11. In sequence block 104, upper CSP 32 and lower CSP 34 are disconnected from one another by operating CSP connector 72 to a disconnected position, see, e.g., FIGS. 1, 3, 12 and 13A. In sequence block 106, marine riser 30 and upper CSP 32 are physically separated (e.g., ejected) from lower CSP 34 and BOP stack 14 by activating ejector device 74 (i.e., ejector bollards), see, e.g., FIGS. 1-3, 13, and 13A. In sequence block 108, (see, e.g., FIGS. 1-3 and 14) blind rams 56 are closed to seal bore 40 (see, e.g. FIG. 3) and shut-off the fluid flow from the subsea well into the environment. In sequence block 110, hydrate formation in lower CSP 34 is treated by injecting methanol, see, e.g., FIGS. 1-3 and 15. In sequence block 112, the open valves 66*a* in vent system 64 are closed, see e.g., FIGS. 1-3 and 16. In sequence block 114, a formation stability test is performed, see, e.g., FIGS. 1-3 and 17.

Figure 5:
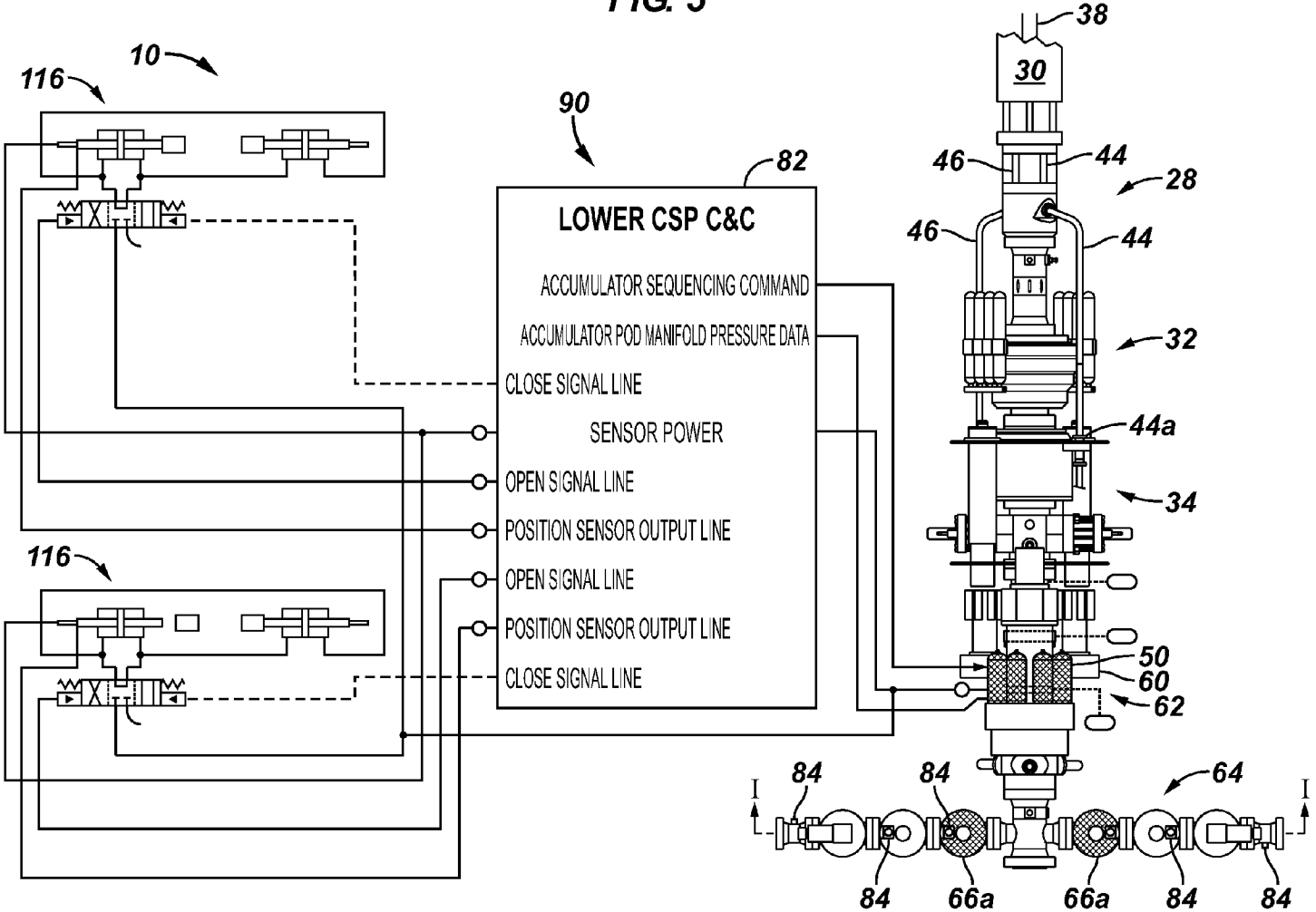
FIGS. 5-17 are schematic diagrams of safing sequence operations according to one or more aspects of a subsea well safing system.

FIG. 5 is a schematic diagram of sequence block 90, according to one or more embodiments of subsea well safing system 10, which is described with further reference to FIGS. 1 and 3. In response to initiating safing sequence 86, one or more vent valves 66*a* of vent system 64 are opened. Valves 66*a* are opened to reduce the flow of fluid through the annulus 41 between tubular 38 and the CSP 28 walls forming bore 40 through CSP 28 (see FIG. 3, the dashed lines in lower CSP 34) and lowering the backpressure on lower slips 60. The open and closed position of vent valves 66*a* can be verified by a control signal from each valve position sensor 84. An accumulator 50 located in the assigned accumulator pod 62 can be activated to provide hydraulic power to the valve actuators 116 of controller 82. Lower controller 82 continuously monitors the pressure at accumulator pod 62 and activates additional accumulators 50 as may be required to maintain working pressure. With reference to FIGS. 5-17, the active device (e.g., accumulators, valves, slips, shears) of the depicted sequence block is emphasized by hatching.

Figure 5A:
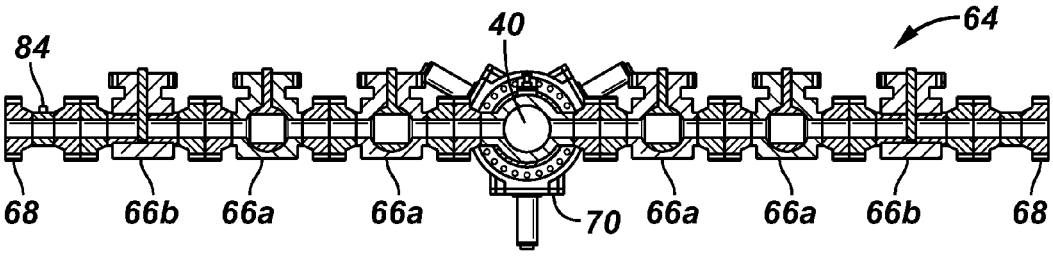
FIG. 5A is a sectional view of a vent system according to one or more aspects shown along the line I-I of FIG. 5.

FIG. 5A is a sectional view of an embodiment of vent system 64 shown along the line I-I of FIG. 5. FIG. 5A depicts two vent valves 66*a* on each side of vent system 64, which are depicted in the closed position. Valves 66*b* are positioned to control flow through connection mandrels 68. In the depicted embodiment, the sensor 84 located proximate to the connection mandrel 84 is an accelerometer.

Figure 6:
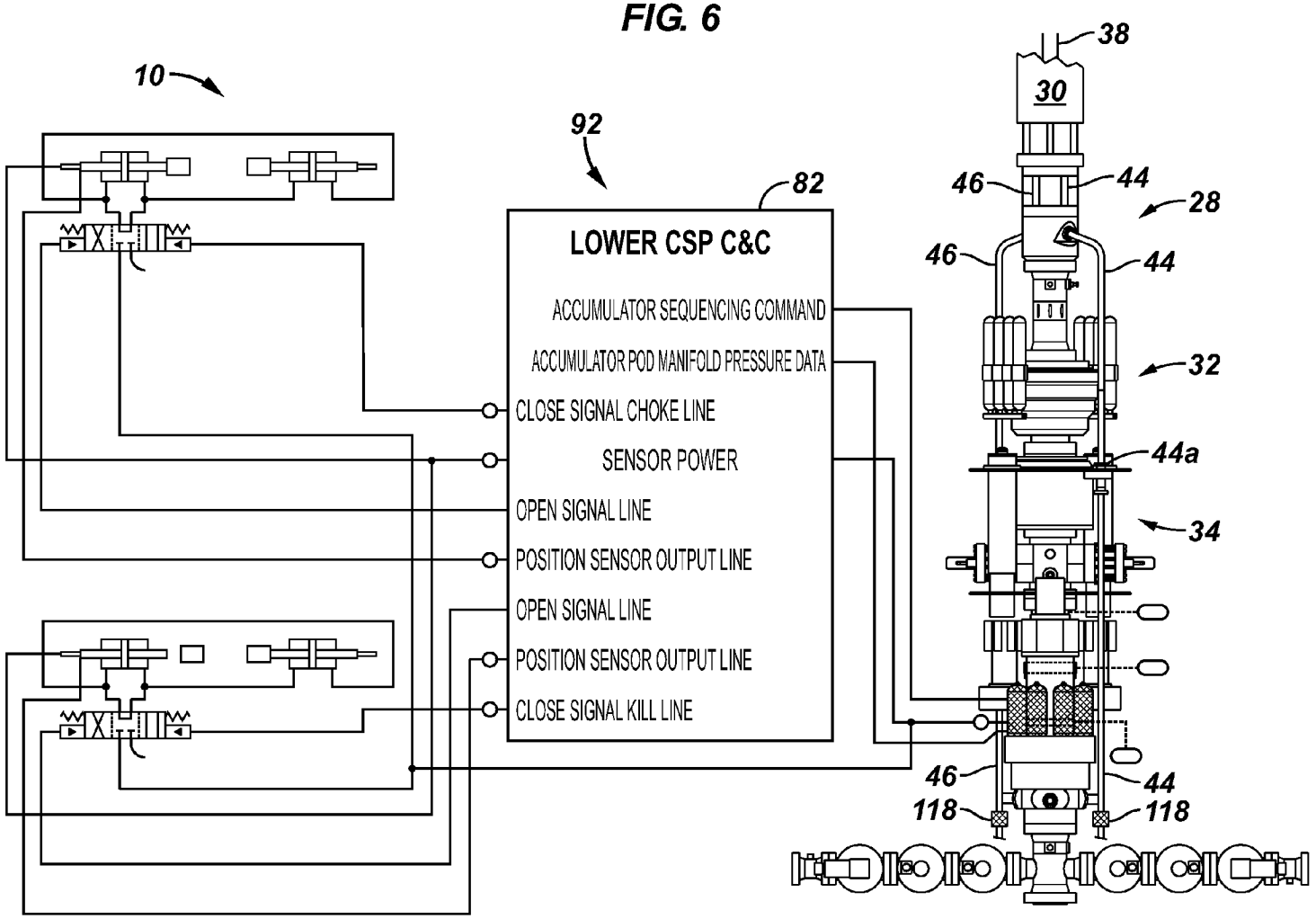

FIG. 6 is a schematic diagram of sequence block 92, according to one or more aspects of subsea well safing system 10, which is described with further reference to FIGS. 1 and 3. In sequence block 92, valves 118 positioned in each of choke line 44 and kill line 46 are actuated from the open to the closed position to prevent combustibles from flowing up the choke line 44 and the kill line 46.

FIG. 7 is a schematic diagram of sequence block 94 according to one or more aspects of subsea well safing system 10, which is described with further reference to FIGS. 1 and 3. Controller 82 initiates the pressurization of wellhead connector lock 120 to prevent the accidental ejection of BOP stack 14 from wellhead 16 due to the high back pressure encountered in subsequent sequence blocks, e.g., when device 70 is closed, slips 48, 60 are closed, and due to the loss of hydraulic pressure to wellhead connector lock 120 when marine riser 30 is disconnected from BOP stack 14 disconnecting any hydraulic sources extending along marine riser 30 to CSP 28.

Figure 8A:
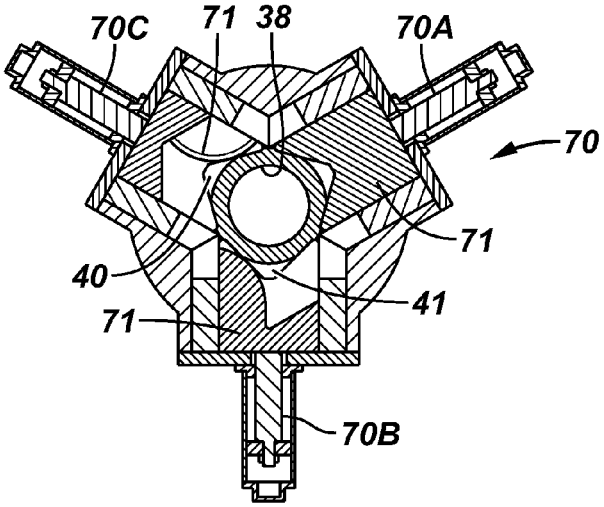
FIG. 8A is a sectional view of a shutter device shown along the line I-I of FIG. 8.
Figure 8B:
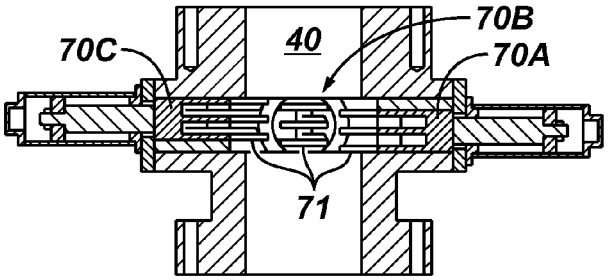
FIG. 8B is a sectional, side view of a shutter device in accordance to one or more aspects.
Figure 8:
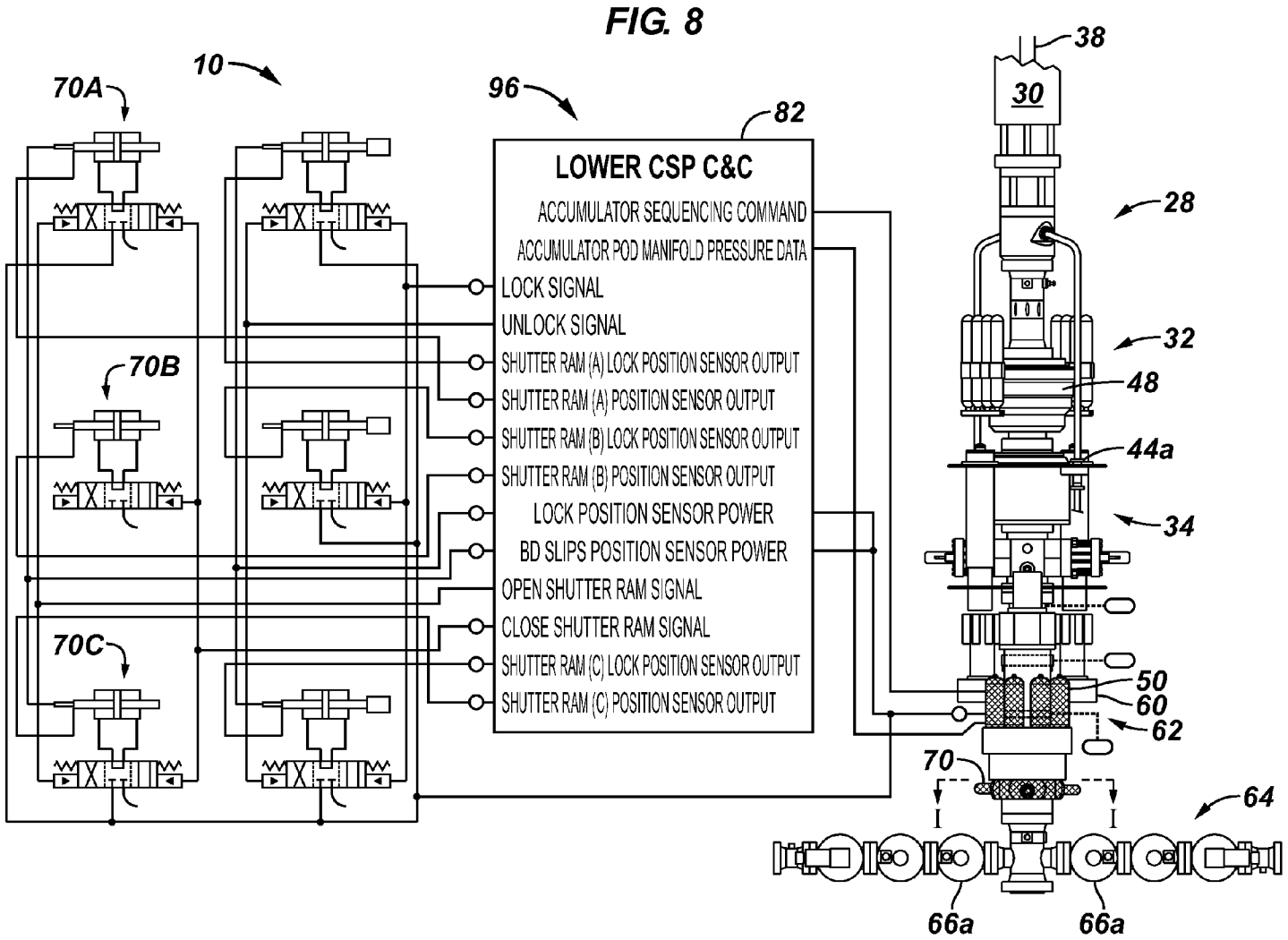

FIG. 8 is a schematic diagram of sequence block 96, according to one or more aspects of subsea well safing system 10, which is described with further reference to FIGS. 1, 3, 8A and 8B. In sequence block 96, controller 82 actuates device 70 to a closed position (see FIG. 8A) in response to applying hydraulic pressure for example from a hydraulic accumulator 50 of lower accumulator pod 62. In the closed position, device 70 can divert fluid flowing from the well to vent system 64 and to open vent valves 66*a* and away from passing through annulus 41 of safing package 28. The closed device 70 depicted in FIG. 8A, protects CSP 28 from the high flow rates and entrained solids that are encountered thereby limiting erosion of devices of CSP 28, such as upper safety slips 48 and lower slips 60. Deflector device 70 may be provided in various manners and configurations. Referring to FIG. 8A, tubular 38 is depicted substantially centered within bore 40 by device 70, which is coaxial with bore 40 of CSP 28, by rams 70A, 70B, and 70C. According to at least one embodiment, closure of rams 70A, 70B, 70C does not seal annulus 41. In the embodiment depicted in FIG. 8B, each of rams 70A, 70B and 70C comprises stacked and spaced apart plates 71 which interleave portions of the plates 71 of the adjacent rams.

Figure 9:
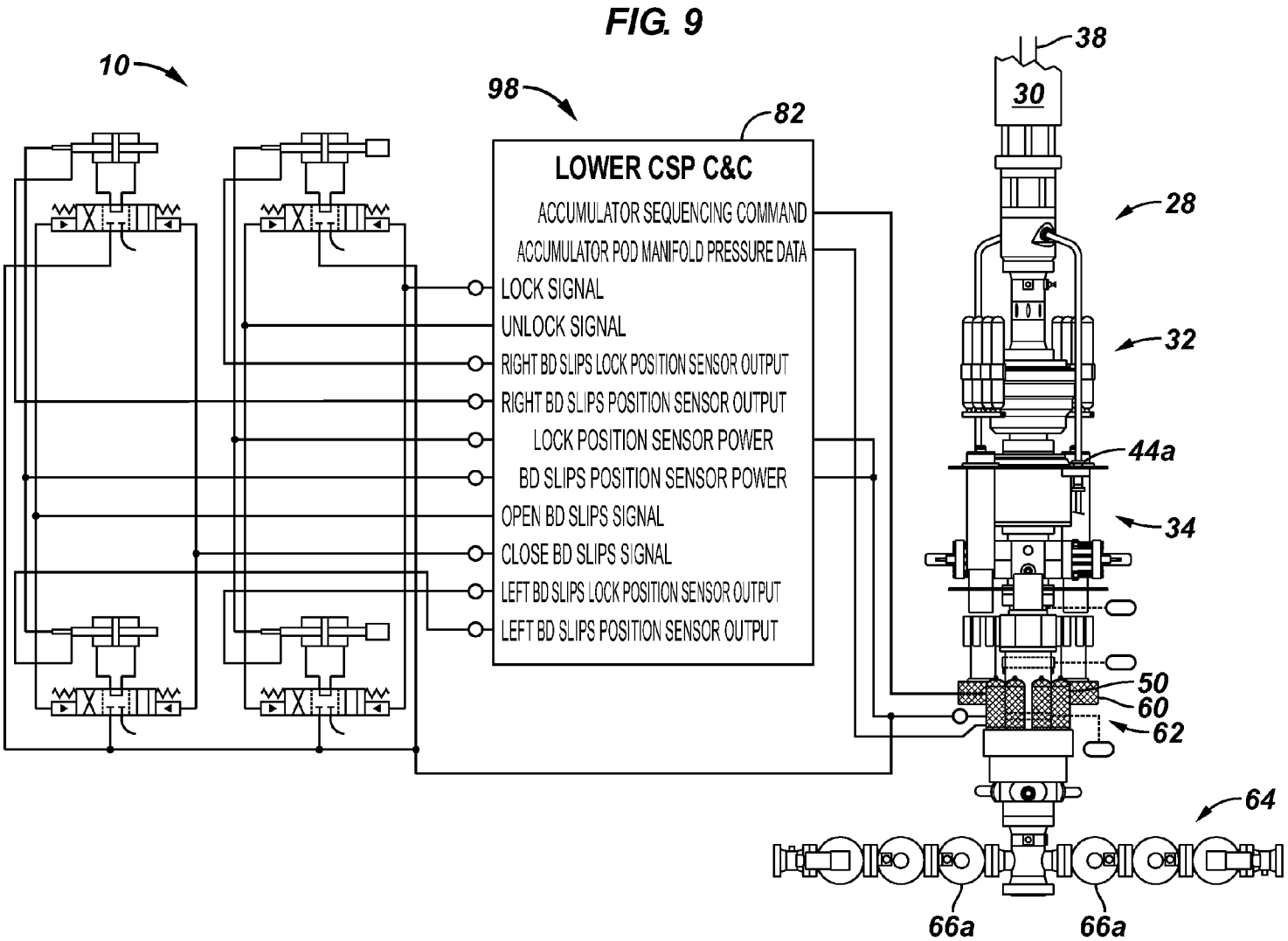

FIG. 9 is a schematic diagram of sequence block 98, according to one or more aspects of subsea well safing system 10, which is described with further reference to FIGS. 1 and 3. In sequence block 98, controller 82 actuates lower slips 60 (e.g., bi-directional slips) securing tubular 38 within lower CSP 34 in preparation for sequence block 102. In some embodiments, lower slips 60 may include deflector armor to divert fluid flow toward vent system 64 instead of, or in addition to, the use of device 70 described for example with reference to sequence block 96 and FIGS. 8, 8A, and 8B.

Figure 10:
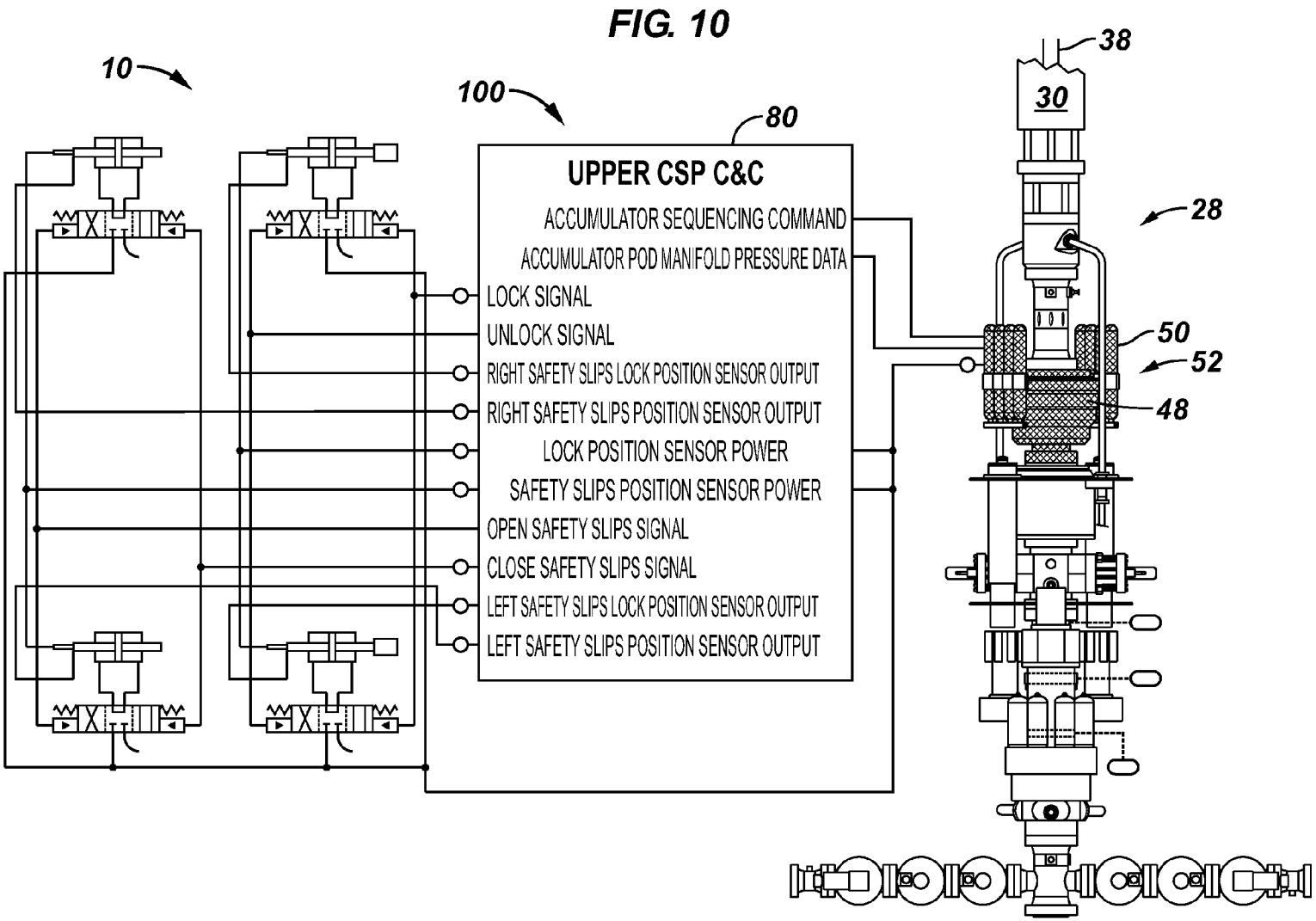

FIG. 10 is a schematic diagram of sequence block 100, according to one or more aspects of subsea well safing system 10, which is described with further reference to FIGS. 1 and 3. In sequence block 100, upper slips 48 are actuated to engage tubular 38 within upper CSP 32. In this embodiment, sequence block 100 is actuated by upper controller 80. As with other sequence blocks, the controller monitors the pressure status of accumulators 50 and if a low pressure is detected, a subsequent accumulator in a pod is activated to actuate the sequence block device (i.e., slips 48 in sequence block 100).

Figure 11:
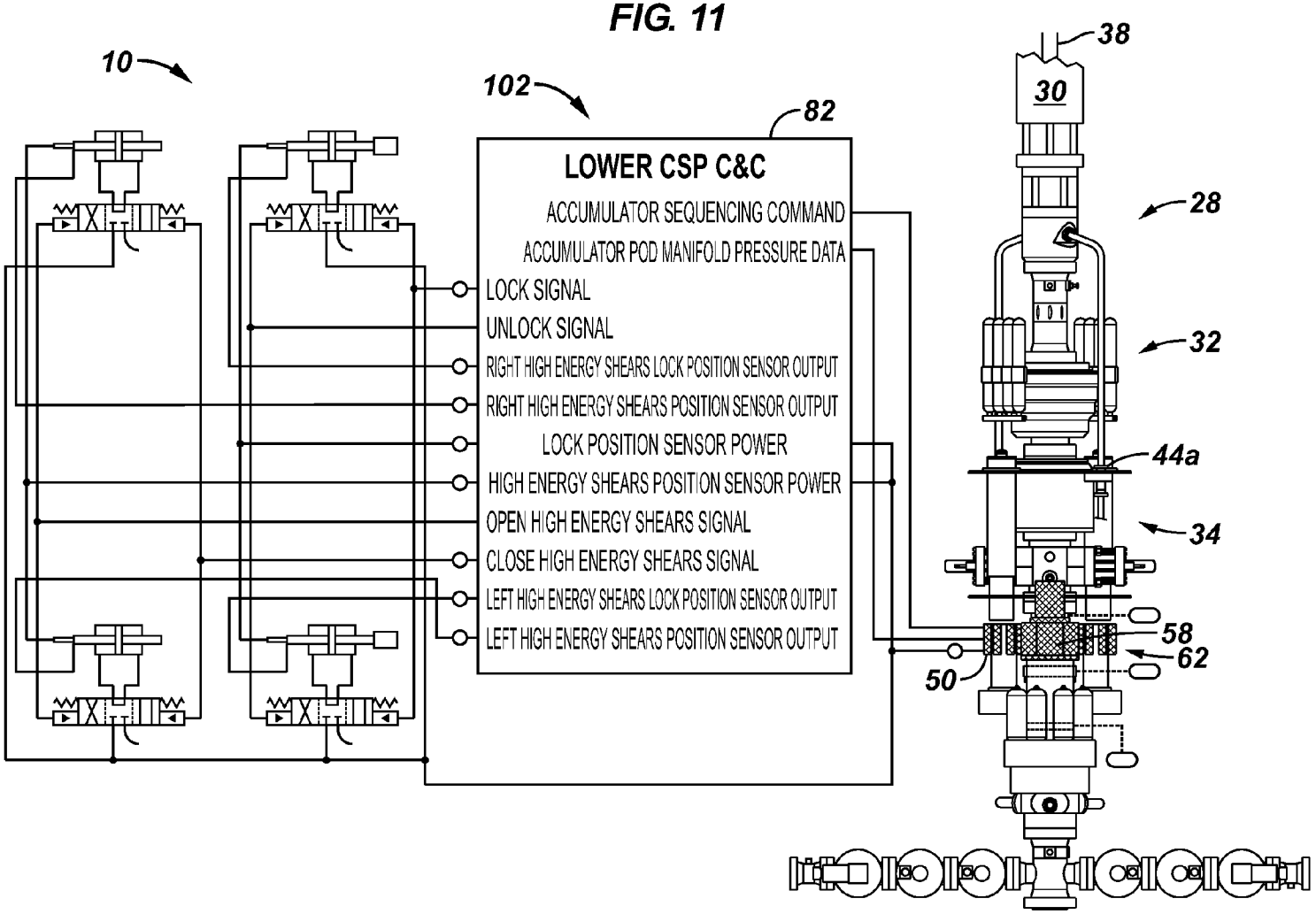

FIG. 11 is a schematic diagram of sequence block 102, according to one or more aspects of subsea well safing system 10, which is described with further reference to FIGS. 1 and 3. After tubular 38 is engaged and secured respectively in upper CSP 32 (i.e., by slips 48) and lower CSP 34 (i.e., slips 60), lower controller 82 actuates shears 58 thereby shearing tubular 38 between upper slips 48 and lower slips 60.

Figure 12:
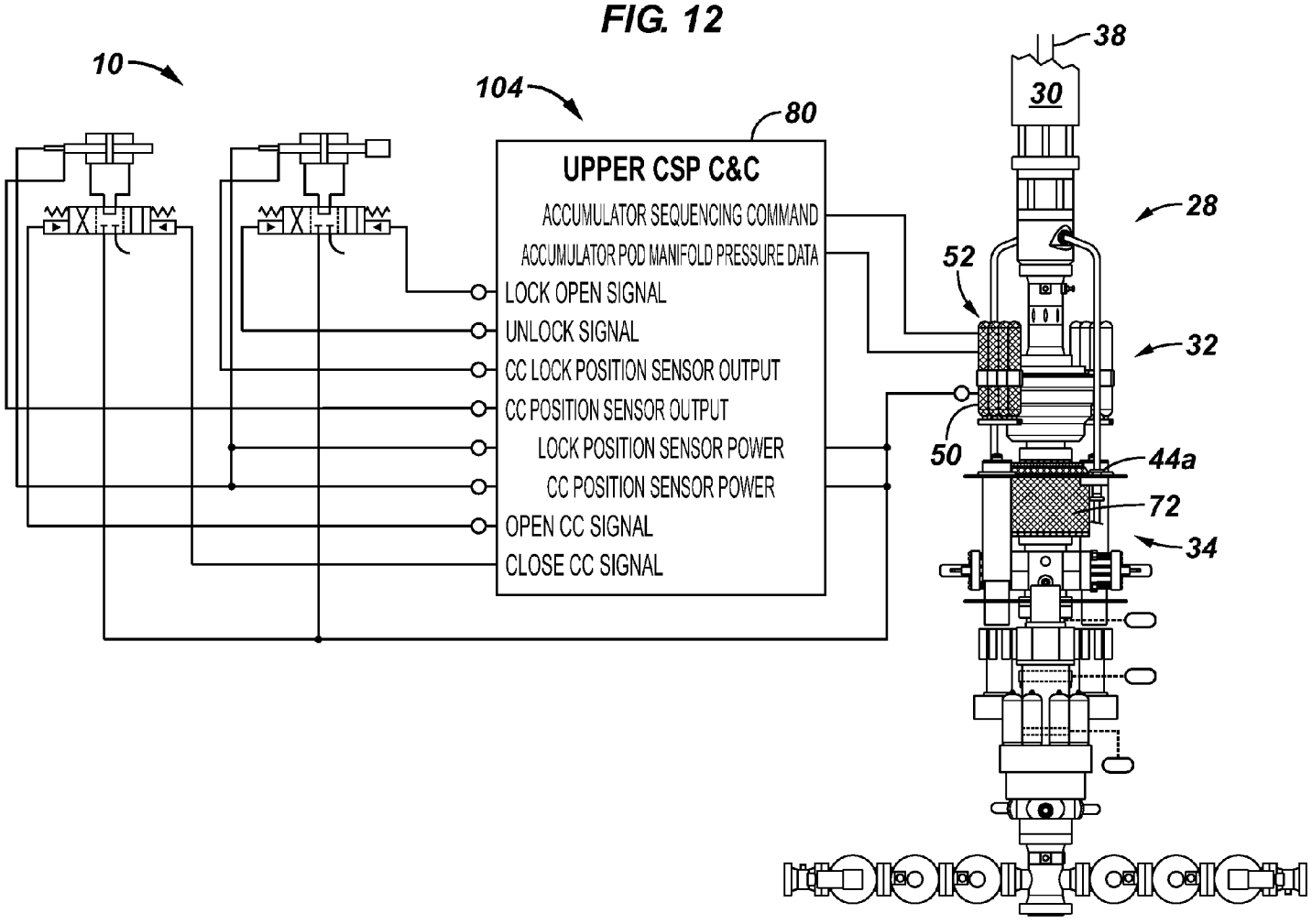

FIG. 12 is a schematic diagram of sequence block 104, according to one or more aspects of subsea well safing system 10, which is described with further reference to FIGS. 1, 2, 3 and 13A. In sequence block 104, CSP connector 72 is actuated to the open or disconnected position permitting separation of upper CSP 32 from lower CSP 34 in sequence block 106. In this embodiment, CSP connector 72 is actuated via upper controller 80 and hydraulic accumulators 50 located in upper accumulator pod 52. In the depicted embodiment, CSP connector 72 is a collet comprising a first connector portion 72*a* and a second connector portion 72*b*, depicted for example in FIG. 13A. Second connector portion 72*b* is disposed with lower CSP 34 and comprises a mandrel, identified individually by the numeral 72*c* (see, FIGS. 13A, 14-17). The mandrel 72*c* provides a mechanism for reconnecting, for example with a marine riser 30, for re-entry into well 18.

Figure 13:
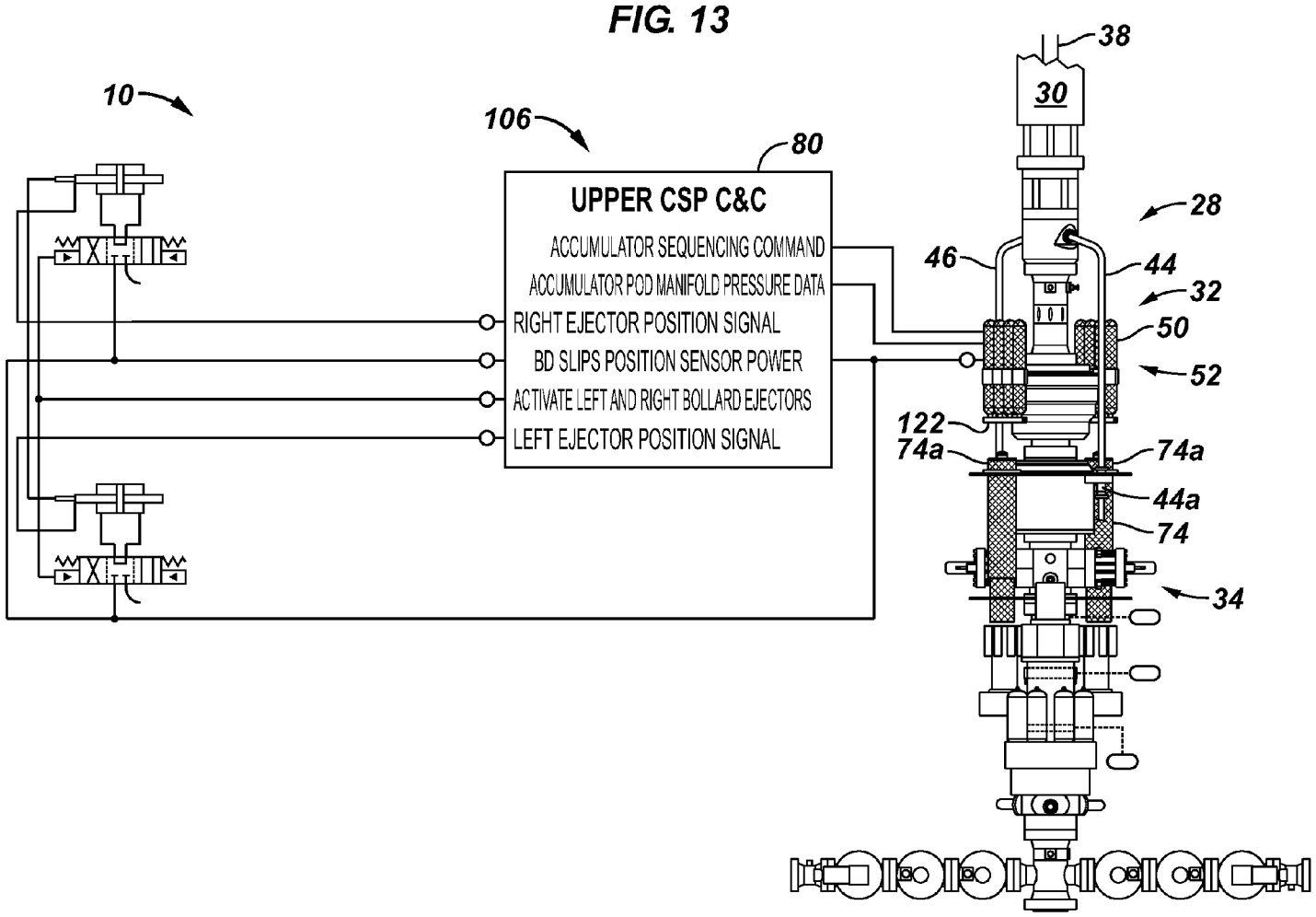
Figure 13A:
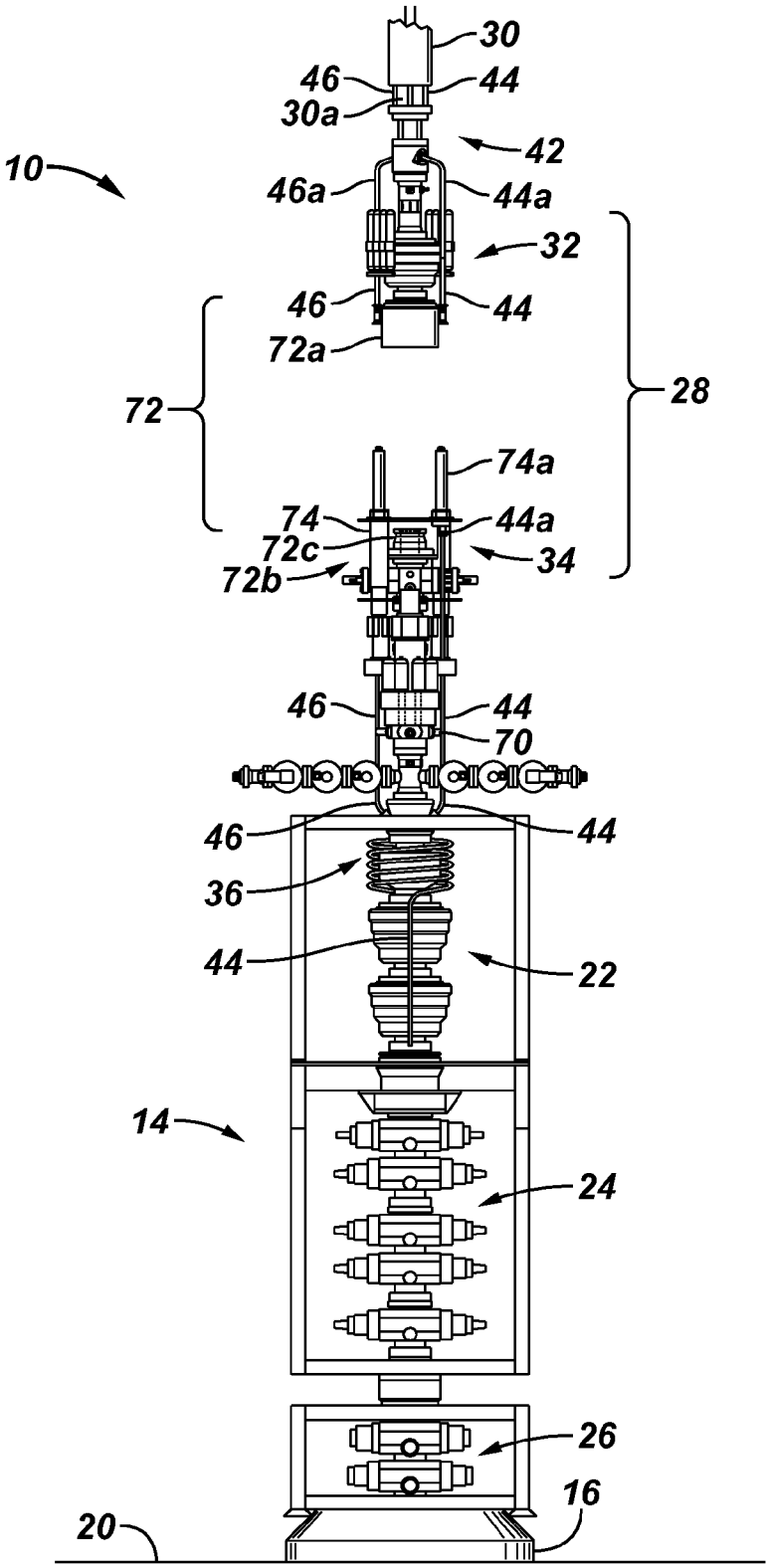
FIG. 13A illustrates the marine riser and upper safing package disconnected and separated from the lower safing package and the wellhead in response to progression of the subsea well safing sequence.

FIG. 13 is a schematic diagram of sequence block 106, according to one or more aspects of subsea well safing system 10, which is described with further reference to FIGS. 1-3 and 13A. In sequence block 106, depicted ejector devices 74 (i.e., ejector bollards) are actuated to physically separate upper CSP 32 and marine riser 30 from lower CSP 34 as depicted in FIGS. 2 and 13A. For example, ejector devices 74 may include piston rods 74*a* which extend to push the upper CSP 32 away from lower CSP 34 in the depicted embodiment. FIGS. 2, 13A, and 14-17 illustrate piston rod 74*a* in an extended position. In FIG. 13, actuation of ejector devices 74 is provided by upper controller 80 and accumulator(s) 50 located in upper accumulator pod 52.

Typically, marine riser 30 will be in tension which will assist in pulling the disconnected upper CSP 32 vertically away from lower CSP 34 which is connected to BOP stack 14. In addition, the water currents and deflection in marine riser 30 (e.g., offset from platform 31) will assist in moving marine riser 30 and the separated upper CSP 32 laterally away from lower CSP 34 and the well. Choke line 44 and kill line 46 are disconnected respectively at choke stab 44*a* and kill stab 46*a* (FIG. 3). Stabs 44*a* and 46*b* provide a mechanism for reconnection to surface sources during recovery operations.

In FIG. 13, ejector device 74 is attached to lower CSP 34 and piston rods 74*a* push against a portion of upper CSP 32, for example a portion of the frame 122 of upper CSP 32. It will be understood by those skilled in the art with benefit of this disclosure that ejector device 74 may be arranged in different configurations without departing from the scope of this disclosure. For example, ejector device 74 may be reversed so as to be attached with upper CSP 32 wherein piston rod 74*a* acts against lower CSP 34.

Figure 14:
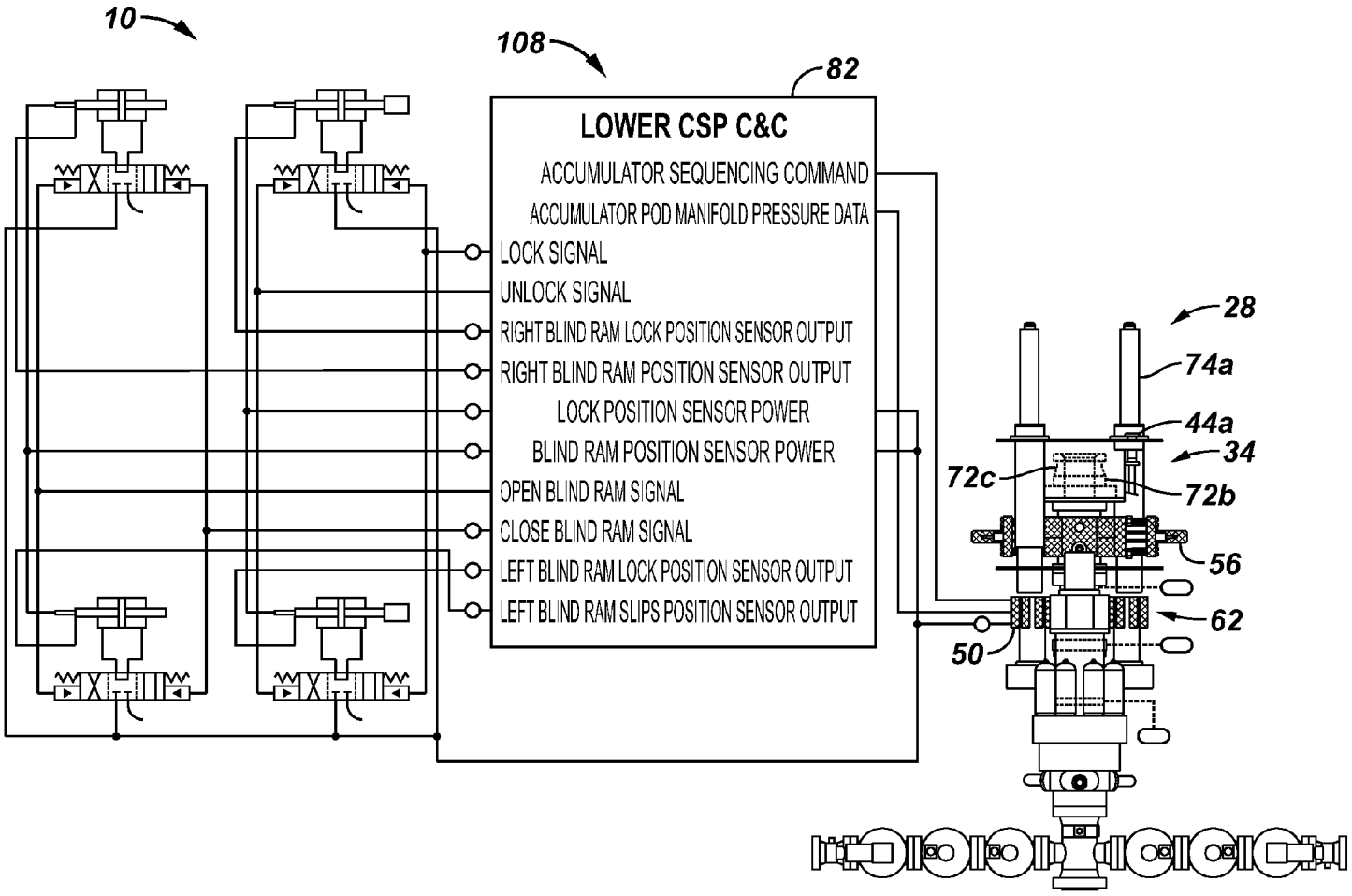

FIG. 14 is a schematic diagram of sequence block 108, according to one or more aspects of subsea well safing system 10, which is described with further reference to FIGS. 1, 2 and 3. In sequence block 108, blind rams 56 are actuated to the closed position sealing bore 40 (see FIGS. 3 and 8A, 8B) to block any fluid that may be flowing up from well 18 through BOP stack 14. The actuation of blind rams 56 may be provided by lower controller 82 and accumulator (s) 50 located in lower accumulator pod(s) 62.

Figure 15:
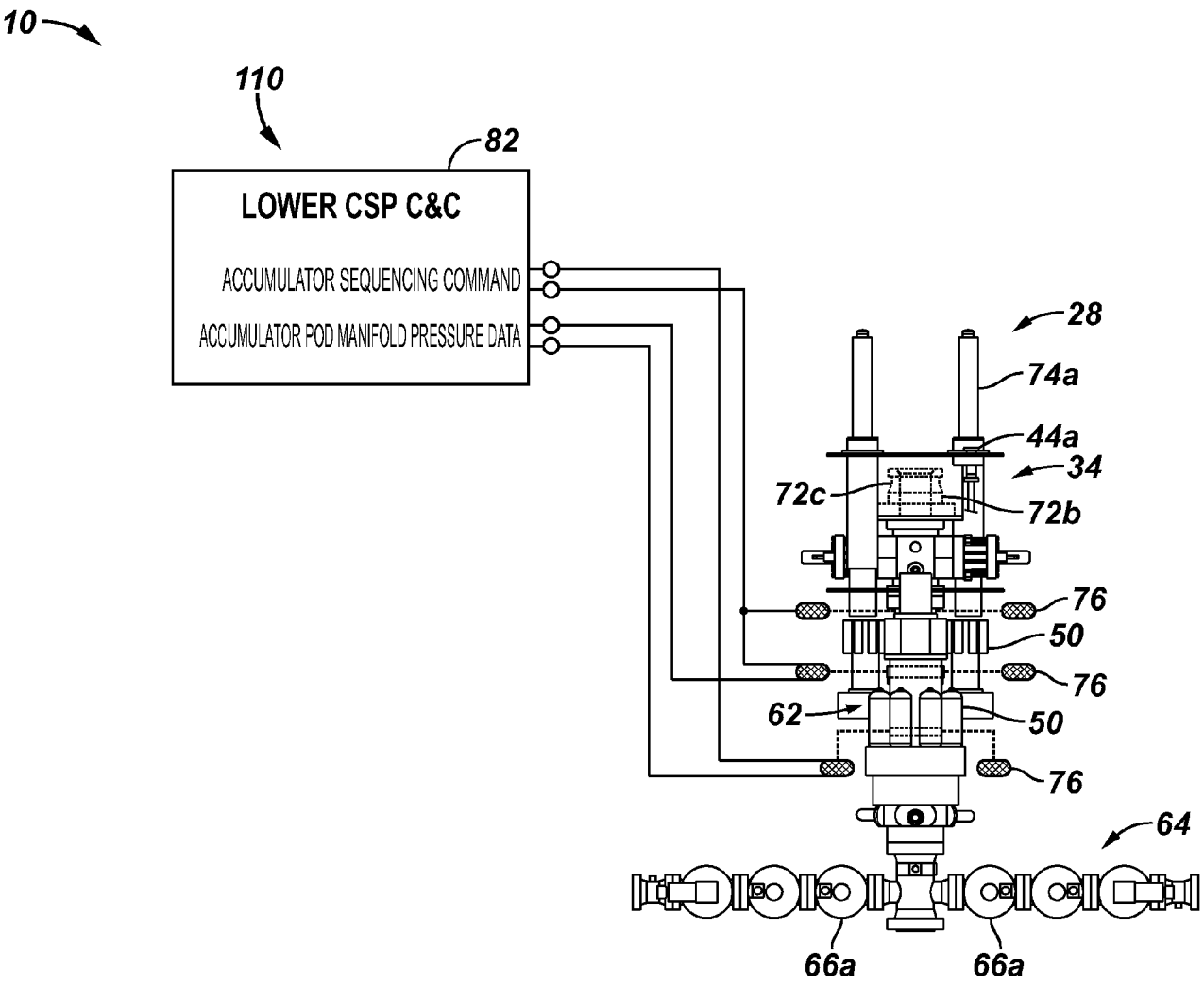

FIG. 15 is a schematic diagram of sequence block 110, according to one or more aspects of subsea well safing system 10, which is described with further reference to FIGS. 1, 2 and 3. In sequence block 110, methanol 76 may be injected into lower CSP 34 to prevent hydrate formation CSP 28, in particular in the vents (e.g., vent valves 66*a*) of vent system 64. The injection of methanol 76 may be provided for example by lower controller 82 and may be powered by accumulator(s) 50 located in lower accumulator pod(s) 62.

Figure 16:
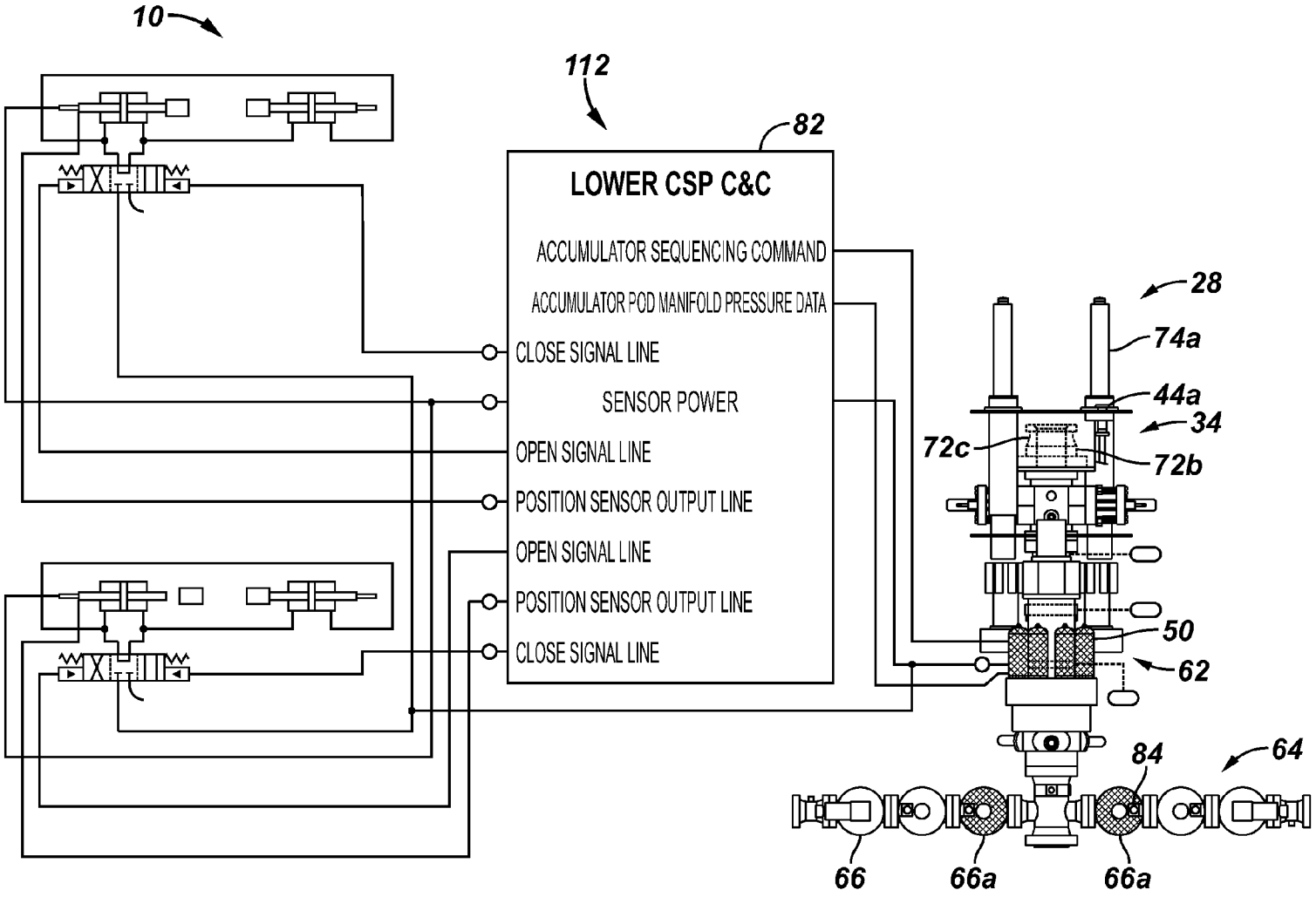

FIG. 16 is a schematic diagram of sequence block 112, according to one or more aspects of subsea well safing system 10, which is described with further reference to FIGS. 1, 2 and 3. In sequence block 112, lower controller 82 actuates hydraulic power (e.g., accumulator 50) to actuate the open vent valves 66*a* from the open to the closed position.

Figure 17:
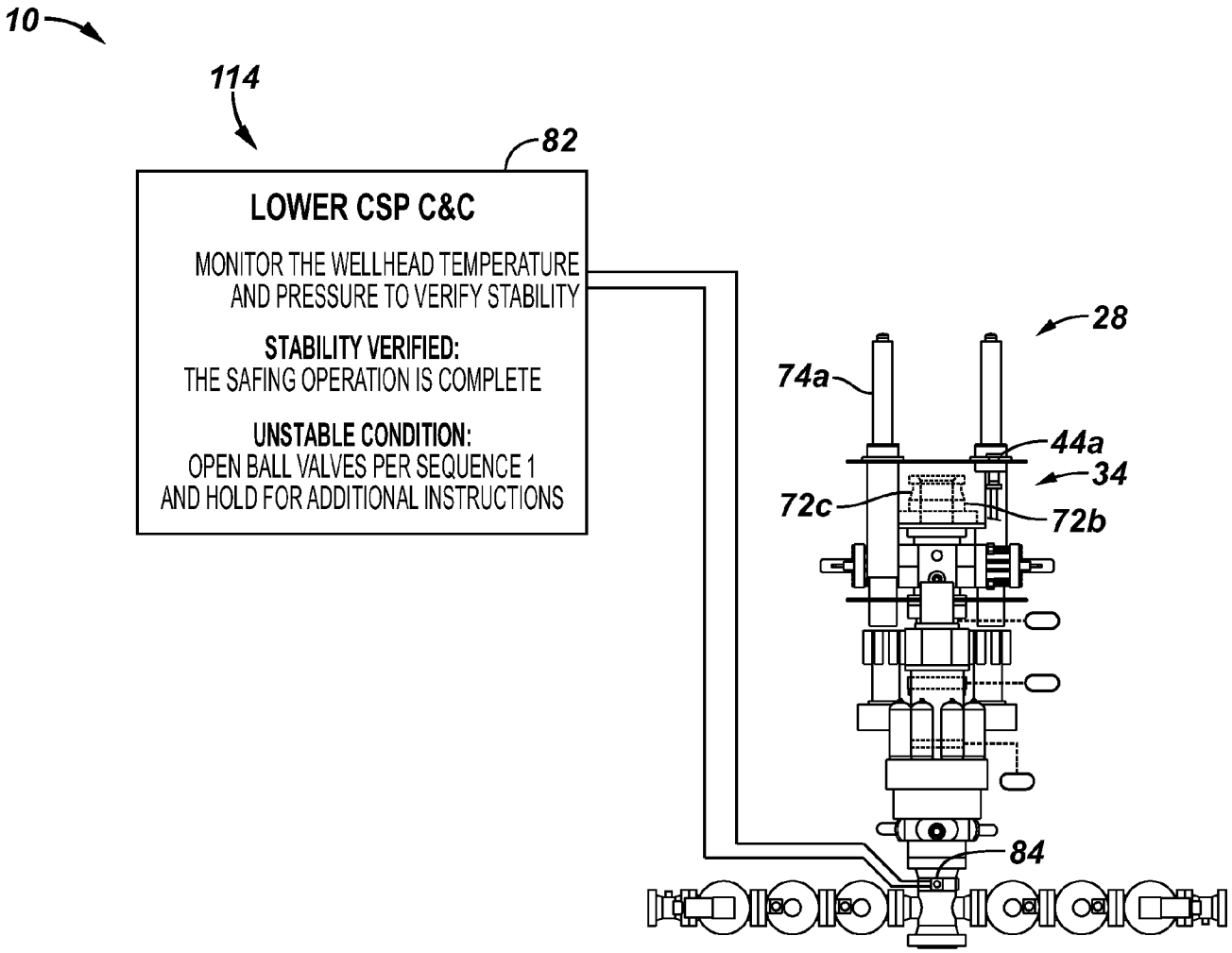

FIG. 17 is a schematic diagram of sequence block 114, according to one or more aspects of subsea well safing system 10, which is described with further reference to FIGS. 1, 2, and 3. Subsequent to closing vent valves 66*a* in sequence block 112, lower controller 82 can initiate and perform a formation stability test for example by monitoring wellhead temperature and pressure via one or more sensors 84.

If stable formation conditions are indicated, safing system 10 may be placed in a standby condition until recovery operations can be initiated and completed. If unstable formation conditions are indicated, vent valves 66*a* may be opened to relieve pressure in an effort to prevent a subsurface blowout of well 18, which will result in loss of the well and require more difficult and time consuming processes to plug well 18. With effluent venting to the environment, a recovery riser 126 extending, for example from a vessel at surface 5, may be connected to connection mandrel 68 of vent system 64 as depicted in FIG. 3. ROV 124 (FIG. 2) may be utilized to connect flexible riser 126. A valve, such as valve 68*b*, may be operated to the open position permitting flow of effluent through mandrel 68 of vent system 64 into recovery riser 126 and to the surface; and the open vent valves 66*a* are operated to the closed position, thus providing a means to mitigate environmental damage until control of well 18 can be recovered.

According to at least one embodiment, a method of recovery of well 18 comprises closing in well 18 via lower CSP 34 and/or venting effluent from well 18 through vent system 64 and a recovery riser 126 to the surface. A marine riser 30 and choke line 44 and/or kill line 46 hydraulics are extended from the surface to lower CSP 34. Choke and kill lines 44, 46 can be connected to BOP stack 14 and well 18 via choke stab 44*a* and kill stab 46*a* which are located on lower CSP 34 which is still connected to well 18. Marine riser 30 in some circumstances may be connected to connector mandrel 72*b* of CSP connector 72 to reestablish hydraulic communication with well 18 through BOP stack 14. Depending on the status of BOP stack 14 and formation stability, drilling mud may be circulated down one of marine riser 30, kill line 46, choke line 44, and/or flexible riser 126 to kill well 18.

According to one or more aspects, a subsea well safing package for installing on a subsea well includes a safing assembly connector interconnecting a lower safing assembly and an upper safing assembly, the safing assembly connector operable to a disconnected position. The lower safing assembly is configured to connect to the subsea well, for example via a blowout preventer stack and the upper safing assembly is configured to be connected to a marine riser. The lower safing assembly may include lower slips to engage a tubular suspended in a bore formed through the lower and the upper safing assemblies and the upper safing assembly may include upper slips operable to engage the tubular. A shear positioned between the upper slips and the lower slips is operable to shear the tubular.

According to one or more aspects a subsea well safing package is provided for installing on a subsea well having a safing assembly connector interconnecting a lower safing assembly and an upper safing assembly. The lower safing assembly including lower slips to engage and secure a tubular suspended in a bore formed through the lower and the upper safing assemblies and the upper safing assembly having upper slips operable to engage the tubular. A shear may be positioned between the upper slips and the lower slips to shear the tubular. The safing package may include an ejector device connected between lower safing assembly and the upper safing assembly that is operable to physically separate the upper safing assembly from the lower safing assembly. The ejector device may include an extendable piston rod.

The well safing package may include a vent operable between an open and a closed position. For example, the vent may be carried by the lower safing assembly and positioned below the lower slips when connected to the well.

A well safing package may include for example a vent carried by the lower safing assembly and positioned below the lower slips well and a deflector device positioned between the lower slips and the vent. The vent may be opened and the shutter device operated to a closed position to divert fluid flow toward the vent. In some embodiments the deflector device does not seal against the tubular suspended in the lower safing assembly.

A subsea well safing system according to one or more aspects includes a lower safing assembly connected to a subsea well and an upper safing assembly connected to a marine riser. A safing assembly connector interconnects the lower safing assembly and the upper safing assembly providing a bore therethrough in communication with the marine riser and the subsea well. An ejector device may be connected between the upper safing assembly and the lower safing assembly to physically separate the upper assembly and the connected marine riser from the lower safing assembly and the well.

The safing assembly may include, for example, lower slips operable to engage and secure a tubular suspended in the bore of the lower safing assembly and upper slips operable to engage and secure the tubular suspend in the bore of the upper safing assembly and a shear located between the lower slips and the upper slips operable to shear the tubular. A vent may be in communication with the bore and operable between a closed position and an open position. The safing system may include a deflector device located in the lower safing assembly between the lower slips and the vent that is operable to a closed position to divert fluid flow for example toward the vent.

A subsea well safing sequence includes utilizing a safing assembly installed between a subsea well and a marine riser. The safing assembly includes a lower safing assembly connected to the subsea well and an upper safing assembly connected to the marine riser, the safing assembly forming a bore between the marine riser and the subsea well. When the well safing sequence is initiated, securing a tubular that is suspended in the bore at a position in the lower safing assembly and securing the tubular at a position in the upper safing assembly. The tubular is sheared in the bore between the positions in the lower and the upper safing assemblies at which the tubular has been secured and physically separating the upper safing assembly and the connected marine riser from the lower safing assembly and the subsea well.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A well system, comprising:

an assembly providing a bore in communication with a wellbore;

a device operable to shear a tubular disposed in the bore; and a shutter device located below the device comprising adjacent rams located circumferentially about the bore, each of the adjacent rams having a plate with a front face, the shutter device operable between an open position with the plates withdrawn from the bore to a closed position with the front faces of the plates contacting the tubular in the bore and the plates of the adjacent rams overlapping one another, wherein the plates do not seal against the tubular, wherein the plate of each of the adjacent rams comprises two or more plates that are stacked and spaced vertically apart whereby in the closed position the two or more plates of the adjacent rams interleave one another.

2. The well system of claim 1, wherein the shutter device comprises three adjacent rams.

3. The well system of claim 1, further comprising slips to engage and secure the tubular in the bore.

4. The well system of claim 1, wherein the assembly comprises lower slips positioned to engage and secure the tubular in the bore below the device operable to shear the tubular.

5. The well system of claim 1, wherein the assembly comprises:

lower slips positioned to engage and secure the tubular in the bore below the device operable to shear the tubular; and upper slips positioned to engage and secure the tubular in the bore above the device operable to shear the tubular.

6. The well system of claim 1, wherein the assembly comprises:

lower slips positioned to engage and secure the tubular in the bore below the device operable to shear the tubular;

upper slips positioned to engage and secure the tubular in the bore above the device operable to shear the tubular; and the shutter device positioned between the lower slips and the wellbore.

7. The well system of claim 1, wherein the shutter device is located below the device operable to shear the tubular and the assembly comprises a valve positioned below the shutter device to selectively vent fluid from the wellbore to a surrounding environment.

8. The well system of claim 1, wherein the front face of each of the plates is substantially V-shaped.

9. The well system of claim 1, wherein the shutter device comprises only three adjacent rams.

10. The well system of claim 1, wherein:

the front face of each of the plates is substantially V-shaped; and the shutter device comprises only three adjacent rams.

11. A device, comprising a bore and adjacent rams located circumferentially about the bore, each of the adjacent rams comprising a plate having a front face, the adjacent rams in use operable between an open position with the plates withdrawn from the bore to a closed position to contact a tubular that is disposed in the bore with the front faces of the plates, wherein in the closed position the plates of the adjacent rams overlap one another and the plates do not seal the bore, wherein the plate of each of the adjacent rams comprises two or more plates that are stacked and spaced vertically apart whereby in the closed position the two or more plates of the adjacent rams interleave one another.

12. The device of claim 11, wherein the adjacent rams comprises three rams.

13. The device of claim 11, wherein the front face of each of the plates is substantially V-shaped.

14. The device of claim 11, wherein:

the front face of each of the plates is substantially V-shaped; and the shutter device comprises only three adjacent rams.

15. A method comprising actuating a shutter device comprising a bore in communication with a wellbore from an open position to a closed position, wherein the shutter device comprises adjacent rams located circumferentially about the bore, each of the adjacent rams having a plate with a front face, wherein in the open position the plates are withdrawn from the bore, and in the closed position the front faces of the plates are contacting a tubular that is disposed in the bore without sealing the bore and the plates of the adjacent rams overlap one another, and wherein the plate of each of the adjacent rams comprises two or more plates that are stacked and spaced vertically apart whereby in the closed position the two or more plates of the adjacent rams interleave one another.

16. The method of claim 15, further comprising shearing the tubular in the bore after actuating the shutter device to the closed position.

17. The method of claim 15, further comprising engaging and securing the tubular in the bore after actuating the shutter device to the closed position.

18. The method of claim 15, further comprising after actuating the shutter device to the closed position:

engaging and securing the tubular in the bore with slips; and shearing the tubular in the bore.

19. The method of claim 15, comprising venting fluid flowing from below the shutter device from the wellbore at a location below the shutter device to a surrounding environment while the shutter device is in the closed position.

20. The method of claim 15, comprising diverting fluid flowing in the wellbore through an open vent located below the shutter device to an environment surrounding the wellbore in response to the shutter device being in the closed position.

21. The method of claim 15, wherein the front face of each of the plates is substantially V-shaped.

22. The method of claim 15, wherein the shutter device comprises only three adjacent rams.

23. The method of claim 15, wherein:

the front face of each of the plates is substantially V-shaped; and the shutter device comprises only three adjacent rams.

24. A well system, comprising:

a device operable to shear a tubular disposed in a bore in communication with a wellbore;

lower slips positioned to engage and secure the tubular in the bore below the device operable to shear the tubular;

upper slips positioned to engage and secure the tubular in the bore above the device operable to shear the tubular; and a shutter device comprising rams operable between an open position withdrawn from the bore to a closed position contacting the tubular in the bore, wherein the rams do not seal against the tubular.

25. The well system of claim 24, comprising a valve positioned below the shutter device to selectively vent fluid from the wellbore to a surrounding environment.

26. The well system of claim 24, wherein each of the rams comprises a plate that contacts the tubular when the shutter device is in the closed position.

* * * * *